US008297381B2

(12) United States Patent
Radford et al.

(10) Patent No.: US 8,297,381 B2
(45) Date of Patent: Oct. 30, 2012

(54) STABILIZER SUBS FOR USE WITH EXPANDABLE REAMER APPARATUS, EXPANDABLE REAMER APPARATUS INCLUDING STABILIZER SUBS AND RELATED METHODS

(75) Inventors: Steven R. Radford, The Woodlands, TX (US); Mark R. Kizziar, Lafayette, LA (US); Mark A. Jenkins, Maud (GB)

(73) Assignee: Baker Hughes Incorporated, Houston, TX (US)

( * ) Notice: Subject to any disclaimer, the term of this patent is extended or adjusted under 35 U.S.C. 154(b) by 602 days.

(21) Appl. No.: 12/501,688

(22) Filed: Jul. 13, 2009

(65) Prior Publication Data

US 2011/0005836 A1 Jan. 13, 2011

(51) Int. Cl.
*E21B 10/26* (2006.01)

(52) U.S. Cl. ..... 175/406; 175/352.2; 175/263; 175/295

(58) Field of Classification Search ..... 175/352.2, 175/263, 295, 344, 406, 57
See application file for complete search history.

(56) References Cited

U.S. PATENT DOCUMENTS

| | | | | |
|---|---|---|---|---|
| 1,548,578 | A | | 8/1925 | Blanchard |
| 1,678,075 | A | | 7/1928 | Phipps |
| 1,772,710 | A | | 8/1930 | Denney |
| 1,804,850 | A | | 5/1931 | Triplett |
| 1,906,427 | A | | 5/1933 | Sievers et al. |
| 2,069,482 | A | | 2/1937 | Seay |
| 2,177,721 | A | | 10/1939 | Johnson et al. |
| 2,344,598 | A | | 3/1944 | Church |
| 2,758,819 | A | | 8/1956 | Kammerer, Jr. et al. |
| 2,799,479 | A | | 7/1957 | Kammerer |
| 2,882,019 | A | | 4/1959 | Carr et al. |
| 3,105,562 | A | | 10/1963 | Stone et al. |
| 3,123,162 | A | | 3/1964 | Rowley |
| 3,126,065 | A | | 3/1964 | Chadderdon |
| 3,211,232 | A | | 10/1965 | Grimmer |
| 3,220,481 | A | | 11/1965 | Park |
| 3,224,507 | A | | 12/1965 | Cordary et al. |
| 3,320,004 | A | | 5/1967 | Garrett |
| 3,332,498 | A | | 7/1967 | Page, Jr. |
| 3,433,313 | A | | 3/1969 | Brown |
| 3,528,516 | A | | 9/1970 | Brown |
| 3,753,471 | A | | 8/1973 | Kammerer, Jr. et al. |
| 3,800,891 | A | | 4/1974 | White et al. |
| 3,845,815 | A | | 11/1974 | Garwood |
| 3,851,719 | A | * | 12/1974 | Thompson et al. ..... 175/406 |
| 3,916,998 | A | | 11/1975 | Bass, Jr. et al. |
| 4,055,226 | A | | 10/1977 | Weber |

(Continued)

FOREIGN PATENT DOCUMENTS

EP 0594420 A1 4/1994

(Continued)

OTHER PUBLICATIONS

International Search Report for PCT/US2007/024796, dated Jul. 11, 2008, 7 pages.

(Continued)

*Primary Examiner* — Kenneth L Thompson
*Assistant Examiner* — Yong-Suk Ro
(74) *Attorney, Agent, or Firm* — TraskBritt

(57) ABSTRACT

An expandable reamer apparatus and stabilizer sub having at least one rib thereon attached thereto for drilling a subterranean formation.

16 Claims, 32 Drawing Sheets

U.S. PATENT DOCUMENTS 4,111,262 A 9/1978 Duncan
4,227,586 A 10/1980 Bassinger
4,304,311 A 12/1981 Shinn
4,440,222 A 4/1984 Pullin
4,456,080 A 6/1984 Holbert
4,458,761 A 7/1984 Van Vreeswyk
4,499,958 A 2/1985 Radtke et al.
4,503,919 A 3/1985 Suied
4,540,941 A 9/1985 Walkow
4,565,252 A 1/1986 Campbell et al.
4,618,009 A 10/1986 Carter et al.
4,635,738 A 1/1987 Schillinger et al.
4,660,657 A 4/1987 Furse et al.
4,665,511 A 5/1987 Rodney et al.
4,693,328 A 9/1987 Furse et al.
4,711,326 A 12/1987 Baugh et al.
4,715,440 A 12/1987 Boxell et al.
4,842,083 A 6/1989 Raney
4,877,092 A 10/1989 Helm et al.
4,884,477 A 12/1989 Smith et al.
4,889,197 A 12/1989 Boe
5,139,098 A 8/1992 Blake
5,175,429 A 12/1992 Hall, Jr. et al.
5,211,241 A 5/1993 Mashaw, Jr. et al.
5,211,541 A 11/1993 Rosenbauch et al.
5,265,684 A 11/1993 Rosenhauch
5,293,945 A 3/1994 Rosenhauch et al.
5,305,833 A 4/1994 Collins
5,318,131 A 6/1994 Baker
5,318,137 A 6/1994 Johnson et al.
5,318,138 A 6/1994 Dewey et al.
5,332,048 A 7/1994 Underwood et al.
5,343,963 A 9/1994 Bouldin et al.
5,368,114 A 11/1994 Tandberg et al.
5,375,662 A 12/1994 Echols, III et al.
5,402,856 A 4/1995 Warren et al.
5,402,859 A 4/1995 Boberg et al.
5,413,180 A 5/1995 Ross et al.
5,437,308 A 8/1995 Morin et al.
5,443,129 A 8/1995 Bailey et al.
5,469,736 A 11/1995 Moake
5,492,186 A 2/1996 Overstreet et al.
5,495,899 A 3/1996 Pastusek et al.
5,497,842 A 3/1996 Pastusek et al.
5,518,073 A 5/1996 Manke et al.
5,558,162 A 9/1996 Manke et al.
5,560,440 A 10/1996 Tibbitts
5,582,258 A 12/1996 Tibbitts et al.
5,647,437 A 7/1997 Braddick et al.
5,651,420 A 7/1997 Tibbitts et al.
5,663,512 A 9/1997 Schader et al.
5,740,864 A 4/1998 De Hoedt et al.
5,746,274 A 5/1998 Voll et al.
5,765,653 A 6/1998 Doster et al.
5,788,000 A 8/1998 Maury et al.
5,823,254 A 10/1998 Dobson et al.
5,853,054 A 12/1998 McGarian et al.
5,862,870 A 1/1999 Hutchinson
5,886,303 A 3/1999 Rodney
5,957,223 A 9/1999 Doster et al.
5,992,518 A 11/1999 Whitlock
5,992,549 A 11/1999 Fuller
6,059,051 A 5/2000 Jewkes et al.
6,070,677 A 6/2000 Johnston, Jr.
RE36,817 E 8/2000 Pastusek et al.
6,131,662 A 10/2000 Ross
6,131,675 A 10/2000 Anderson
6,138,779 A 10/2000 Boyce
6,179,066 B1 1/2001 Nasr et al.
6,213,226 B1 4/2001 Eppink et al.
6,227,312 B1 5/2001 Eppink et al.
6,289,999 B1 9/2001 Dewey et al.
6,325,151 B1 12/2001 Vincent et al.
6,328,117 B1 12/2001 Berzas et al.
6,360,831 B1 3/2002 Akesson et al.
6,378,632 B1 4/2002 Dewey et al.
6,494,272 B1 12/2002 Eppink et al.
6,499,537 B1 12/2002 Dewey et al.
6,533,050 B2 3/2003 Molloy
6,615,933 B1 9/2003 Eddison
6,651,756 B1 11/2003 Costo, Jr. et al.
6,668,936 B2 12/2003 Williamson, Jr. et al.
6,668,949 B1 12/2003 Rives
6,695,080 B2 2/2004 Presley et al.
6,702,020 B2 3/2004 Zachman et al.
6,732,817 B2 5/2004 Dewey et al.
6,739,416 B2 5/2004 Presley et al.
6,880,650 B2 4/2005 Hoffmaster et al.
6,886,633 B2 5/2005 Fanuel et al.
6,200,944 B1 7/2005 Eppink et al.
6,920,930 B2 7/2005 Allamon et al.
6,920,944 B2 7/2005 Eppink et al.
6,991,046 B2 1/2006 Fielder et al.
7,021,389 B2 4/2006 Bishop et al.
7,036,611 B2 5/2006 Radford et al.
7,048,078 B2 5/2006 Dewey et al.
7,069,775 B2 7/2006 Fredette et al.
7,083,010 B2 8/2006 Eppink et al.
7,100,713 B2 9/2006 Tulloch
7,108,067 B2 9/2006 Themig et al.
7,234,542 B2 6/2007 Vail, III
7,251,590 B2 7/2007 Huang et al.
7,252,163 B2 8/2007 Ollerenshaw et al.
7,287,603 B2 10/2007 Hay et al.
7,293,616 B2 11/2007 Tulloch
7,308,937 B2 12/2007 Radford et al.
7,314,099 B2 1/2008 Dewey et al.
7,325,630 B2 2/2008 Takhaundinov et al.
7,395,882 B2 7/2008 Oldham et al.
7,451,836 B2 11/2008 Hoffmaster et al.
7,451,837 B2 11/2008 Hoffmaster et al.
7,464,013 B2 12/2008 Huang et al.
7,493,971 B2 2/2009 Nevlud et al.
7,506,703 B2 3/2009 Campbell et al.
7,513,318 B2 4/2009 Underwood et al.
7,549,485 B2 6/2009 Radford et al.
7,658,241 B2 2/2010 Lassoie et al.
7,665,545 B2 2/2010 Telfer
7,757,787 B2 7/2010 Mackay et al.
7,814,990 B2 10/2010 Dykstra et al.
7,832,506 B2 11/2010 Liang et al.
7,845,436 B2 12/2010 Cooley et al.
2001/0017224 A1 8/2001 Evans et al.
2004/0149493 A1 8/2004 McDonough
2005/0145417 A1 7/2005 Radford et al.
2005/0241856 A1 11/2005 Lassoie et al.
2005/0259512 A1 11/2005 Mandal
2005/0274546 A1 12/2005 Fanuel et al.
2005/0284659 A1 12/2005 Hall et al.
2006/0113113 A1 6/2006 Underwood et al.
2006/0118339 A1 6/2006 Takhaundinov et al.
2006/0124317 A1 6/2006 Telfer
2006/0144623 A1 7/2006 Ollerensaw et al.
2006/0207801 A1 9/2006 Clayton
2006/0249307 A1 11/2006 Ritter et al.
2007/0005316 A1 1/2007 Paez
2007/0017708 A1 1/2007 Radford et al.
2007/0089912 A1 4/2007 Eddison et al.
2007/0192071 A1 8/2007 Huang et al.
2008/0105464 A1 5/2008 Radford
2008/0110678 A1 5/2008 Radford et al.
2008/0128169 A1 6/2008 Radford et al.
2008/0128174 A1 6/2008 Radford et al.
2008/0128175 A1 6/2008 Radford et al.
2009/0114448 A1 5/2009 Laird et al.
2009/0145666 A1 6/2009 Radford et al.
2009/0294178 A1 12/2009 Radford
2010/0006282 A1 1/2010 Dirdal
2010/0224414 A1 9/2010 Radford et al.

FOREIGN PATENT DOCUMENTS

EP 0594420 B1 4/1994
EP 1188898 A2 3/2002
EP 1614852 A 1/2006
GB 2420803 A 6/2006
GB 2393461 B 10/2006
GB 2426269 B 2/2007

| | | |
|---|---|---|
| RU | 2172385 | 3/2000 |
| WO | 9421889 | 9/1994 |
| WO | 0235048 | 5/2002 |
| WO | 2004074630 | 9/2004 |
| WO | 2006083738 | 8/2006 |
| WO | 2007017651 A | 2/2007 |

OTHER PUBLICATIONS

Written Opinion of the International Searching Authority for PCT/US2007/024796, dated Jul. 11, 2008, 10 pages.
PCT International Search Report for International Application No. PCT/US2007/024795, mailed May 28, 2008.
U.S. Appl. No. 12/058,384, filed Mar. 28, 2008, entitled "Stabilizer and Reamer System Having Extensible Blades and Bearing Pads and Method of Using Same," by Radford et al.
Merriam-Webster Dictionary, Defintions of "Retain" and "Keep" accessed May 20, 2010 from www.merriam-webster.com.
International Search Report for PCT/US2007/024796 dated Jul. 11, 2008, 7 pages.
PCT International Search Report for International Application No. PCT/US2009/042511, mailed Dec. 1, 2009.
Radford, Steven, et al., "Novel Concentric Expandable Stabilizer Results in Increased Penetration Rates and Drilling Efficiency with Reduced Vibration," SPE/IADC 119534, prepared for presentation at the SPE/IADC Drilling Conference and Exhibition held in Amsterdam, The Netherlands, Mar. 17-19, 2009, 13 pages.
U.S. Appl. No. 12/416,386, filed Apr. 1, 2009, entitled "Compound Engagement Profile on a Blade of a Down-Hole Stabilizer and Methods Therefor," by Steven R. Radford.
International Search Report for International Application No. PCT/US2010/025867 mailed Oct. 15, 2010, 3 pages.
International Written Opinion for International Application No. PCT/US2010/025867 mailed Oct. 15, 2010, 6 pages.
International Search Report for International Application No. PCT/US2009/038194, mailed Nov. 9, 2009.
International Search Report for International Application No. PCT/US2010/041676 mailed Feb. 22, 2011, 4 pages.
International Written Opinion for International Application No. PCT/US2010/041676 mailed Feb. 22, 2011, 3 pages.
International Preliminary Report on Patentability for International Application No. PCT/US2010/041676 dated Jan. 17, 2012, 4 pages.
PCT International Search Report and Written Opinion of the International Searching Authority for PCT/US2009/039097, dated Oct. 28, 2009, 8 pages.
Schlumberger Oilfield Glossary entry for "Caliper Log" as it appeared Sep. 3, 2005. Accessed via www.archive.org.
Baker Hughes—Hughes Christensen, GuagePro XPR Expandable Reamer, 2008, pp. 1-2, www.HCCbits.com.
Thomson, I., Radford, S., Powers, J., Shale, L. and Jenkins, M. "A Systematic Approach to a Better Understanding of the Concentric Hole-Opening Process Utilizing Drilling Mechanics and Drilling Dynamics Measurements Recorded Above and Below the Reamer." IADC/SPE 112647, 2008 IADC/SPE Drilling Conference, Mar. 4-6, 2008, Orlando, Florida.
Dr. M. Wells, T. Marvel and C. Beuershausen. "Bit Bailing Mitigation in PDC Bit Design." International Association of Drilling Contractors/Society of Petroleum Engineers—IADC/SPE 114673, IADC/SPE Asia Pacific Drilling Technology Conference and Exhibition, Aug. 25-27, 2008, Indonesia.
International Preliminary Report on Patentability for International Application No. PCT/US2010/041676 dated Jan. 17, 2012, 5 pages.

* cited by examiner

STABILIZER SUBS FOR USE WITH EXPANDABLE REAMER APPARATUS, EXPANDABLE REAMER APPARATUS INCLUDING STABILIZER SUBS AND RELATED METHODS

CROSS-REFERENCE TO RELATED APPLICATION

This application is related to U.S. patent application Ser. No. 11/949,259, filed Dec. 3, 2007, now U.S. Pat. No. 7,900,717, issued Mar. 8, 2011, entitled Expandable Reamers for Earth Boring Applications, which is a non-provisional of U.S. Patent Application No. 60/872,744, filed Dec. 4, 2006; U.S. patent application Ser. No. 11/949,405, filed Dec. 3, 2007, entitled Restriction Element Trap for Use With an Actuation Element of a Downhole Apparatus and Method of Use, and U.S. patent application Ser. No. 12/058,384, filed Mar. 28, 2008, now U.S. Pat. No. 7,882,905, issued Feb. 8, 2011, entitled Stabilizer and Reamer System Having Extensible Blades and Bearing Pads and Method of Using Same, each of which is assigned to the assignee of the present patent application.

TECHNICAL FIELD

Embodiments herein relate generally to an expandable reamer apparatus and a stabilizer therefor for drilling a subterranean borehole and, more particularly, to an expandable reamer apparatus for enlarging a subterranean borehole beneath a casing or liner and a stabilizer therefor.

BACKGROUND

Expandable reamer apparatuses are typically employed for enlarging subterranean boreholes. Conventionally, in drilling oil, gas, and geothermal wells, casing is installed and cemented to prevent the well bore walls from caving into the subterranean borehole while providing requisite shoring for subsequent drilling operations to achieve greater depths. Casing is also conventionally installed to isolate different formations, to prevent crossflow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, assigned to the assignee of the present application. A bi-center bit assembly employs two longitudinally superimposed bit sections with laterally offset axes, which when rotated produce an enlarged borehole diameter. An example of a bi-center bit is disclosed in U.S. Pat. No. 5,957,223, which is also assigned to the assignee of the present application.

Another conventional approach used to enlarge a subterranean borehole includes employing an extended bottom hole assembly with a pilot drill bit at the distal end thereof and a reamer assembly some distance above. This arrangement permits the use of any standard rotary drill bit type, be it a rock bit or a drag bit, as the pilot bit, and the extended nature of the assembly permits greater flexibility when passing through tight spots in the borehole as well as the opportunity to effectively stabilize the pilot drill bit so that the pilot hole and the following reamer will traverse the path intended for the borehole. This aspect of an extended bottom hole assembly is particularly significant in directional drilling. The assignee of the present application has, to this end, designed as reaming structures so called "reamer wings," which generally comprise a tubular body having a fishing neck with a threaded connection at the top thereof and a tong die surface at the bottom thereof, also with a threaded connection. U.S. Pat. Nos. 5,497,842 and 5,495,899, both assigned to the assignee of the present application, disclose reaming structures including reamer wings. The upper midportion of the reamer wing tool includes one or more longitudinally extending blades projecting generally radially outwardly from the tubular body, the outer edges of the blades carrying PDC cutting elements.

As mentioned above, conventional expandable reamer apparatuses may be used to enlarge a subterranean borehole and may include blades pivotably or hingedly affixed to a tubular body and actuated by way of a piston disposed therein as disclosed by U.S. Pat. No. 5,402,856 to Warren. In addition, U.S. Pat. No. 6,360,831 to Åkesson et al. discloses a conventional borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string and once the tool has passed beyond the end of the casing, the blades are extended so the bore diameter may be increased below the casing.

The blades of conventional expandable reamer apparatuses have been sized to minimize a clearance between themselves and the tubular body in order to prevent any drilling mud and earth fragments from becoming lodged in the clearance and binding the blade against the tubular body. The blades of these conventional expandable reamer apparatuses utilize pressure from inside the tool to apply force radially outward against pistons which move the blades, carrying cutting elements, laterally outward. It is felt by some that the nature of the conventional reamers allows misaligned forces to cock and jam the pistons and blades, preventing the springs from retracting the blades laterally inward. Also, designs of these conventional expandable reamer apparatus assemblies fail to help blade retraction when jammed and pulled upward against the borehole casing. Furthermore, some conventional hydraulically actuated reamers utilize expensive seals disposed around a very complex shaped and expensive piston, or blade, carrying cutting elements. In order to prevent cocking, some conventional reamers are designed having the piston shaped oddly in order to try to avoid the supposed cocking, requiring matching, complex seal configurations. These seals are feared to possibly leak after extended usage.

Other conventional reamers require very close tolerances (such as six-thousandths of an inch (0.006") in some areas) around the pistons or blades. Testing suggests that this may be a major contributor to the problem of the piston failing to retract the blades back into the tool, due to binding caused by particulate-laden drilling mud.

Notwithstanding the various prior approaches to drill and/or ream a larger diameter borehole below a smaller diameter borehole, the need exists for improved apparatus and methods for doing so. For instance, bi-center and reamer wing assemblies are limited in the sense that the pass through diameter of such tools is nonadjustable and limited by the reaming diameter. Furthermore, conventional bi-center and eccentric bits may have the tendency to wobble and deviate from the path intended for the borehole. Conventional expandable reamer apparatus assemblies, while sometimes more stable than bi-center and eccentric bits, may be subject to damage when passing through a smaller diameter borehole or casing section, may be prematurely actuated, may present difficulties in removal from the borehole after actuation, and may exhibit wobble and deviate from the path of the intended borehole or suffer slower cutting rates due to damage or wear thereto before being used in the borehole.

Accordingly, there is an ongoing desire to improve or extend performance of an expandable reamer apparatus regardless of the subterranean formation type being drilled, by minimizing wobble of the expandable reamer apparatus during use. There is a further desire to provide an expandable reamer apparatus that provides fail-safe blade retraction, is robustly designed with conventional seal or sleeve configurations, and may not require sensitive tolerances between moving parts.

BRIEF SUMMARY

The embodiments herein relate to an expandable reamer apparatus and a stabilizer sub attached thereto for drilling a subterranean formation.

In one embodiment, a stabilizer sub including at least one stabilizer rib thereon is directly attached to the lower connection of the housing of an expandable reamer apparatus without any intervening drill pipe connected between the housing of the expandable reamer apparatus and the stabilizer sub.

If a stabilizer sub is not used with the expandable reamer apparatus directly attached to the lower connection of the housing of an expandable reamer apparatus, at least one stabilizer rib may be included on the housing of the expandable reamer apparatus.

In some instances, a stabilizer sub including at least one stabilizer rib thereon is directly attached to the upper connection of the housing of an expandable reamer apparatus as well as one or more stabilizer subs including at least one stabilizer rib thereon directly attached to the lower connection of the housing of an expandable reamer apparatus, both stabilizer subs attached to the housing of an expandable reamer apparatus without any intervening drill pipe connected between the stabilizer sub and the housing of the expandable reamer apparatus.

BRIEF DESCRIPTION OF THE DRAWINGS

While the specification concludes with claims particularly pointing out and distinctly claiming various features and advantages of the embodiments herein may be more readily ascertained from the following description of the embodiments herein when read in conjunction with the accompanying drawings, in which:

DETAILED DESCRIPTION

The illustrations presented herein are, in some instances, not actual views of any particular reamer tool, cutting element, or other feature of a reamer tool, stabilizer sub, and sub but are merely idealized representations that are employed to describe the embodiments of a reamer bit and stabilizer sub. Additionally, elements common between figures may retain the same numerical designation.

Typically, when using an expandable reamer apparatus, a stabilizer is run immediately below the expandable reamer or within a distance of approximately ten (10) feet below the expandable reamer apparatus. In some instances, another stabilizer is run a distance of approximately 30 feet or 60 feet above the expandable reamer apparatus in addition to the running a stabilizer below the expandable reamer apparatus. The embodiments of the combination of an expandable reamer apparatus and a stabilizer sub directly connect or attach the stabilizer sub to a connection of the housing of the expandable reamer apparatus without the use of either a joint of drill pipe or a shortened piece of drill collar or drill pipe or equivalent sub separating the stabilizer sub from the expandable reamer apparatus. If a stabilizer sub is not used with the expandable reamer apparatus, the expandable reamer apparatus includes at least one stabilizer rib thereon to include stabilization of the expandable reamer apparatus directly on the expandable reamer apparatus without the use of a separate stabilizer or stabilizer sub. When a stabilizer sub is directly connected or attached to a connection of the housing of the expandable reamer apparatus, without the use of either a joint of drill pipe or a shortened piece of drill pipe or equivalent sub separating the stabilizer sub from the expandable reamer apparatus, increased stabilization of the expandable reamer apparatus results over that when the stabilizer is separated from the expandable reamer apparatus through the use of one to three joints of drill pipe or one to three joints of drill pipe and subs. Further, the overall assembly of an expandable reamer apparatus and stabilizer sub is more easily assembled for use and deployment in a well in a shorter period of time over that of an expandable reamer apparatus and separated stabilizer with intervening drill pipe and/or subs. In those instances where the expandable reamer apparatus includes at least one stabilizer rib thereon, a sub is directly connected or attached to a connection of the housing of the expandable reamer apparatus for connection to drill pipe providing easy assembly and use of the expandable reamer apparatus in a well.

Figure 1:
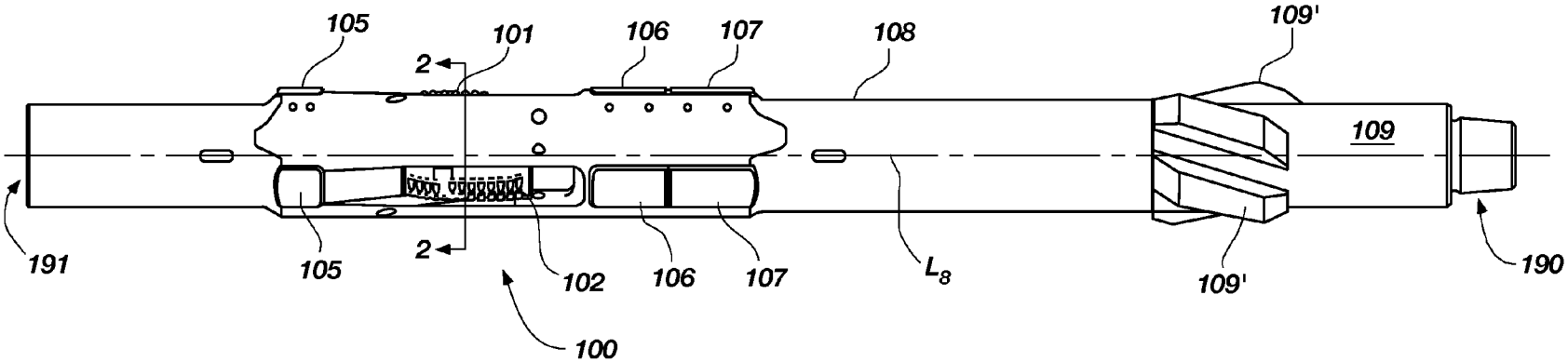
FIG. 1 is a side view of an embodiment of an expandable reamer apparatus and stabilizer.

Shown in FIG. 1 is an expandable reamer apparatus 100 with a stabilizer sub 109. The expandable reamer apparatus 100 may include a generally cylindrical tubular body 108 having a longitudinal axis $L_8$. The expandable reamer apparatus 100 typically includes a lower stabilizer sub 109 shown in cross-section in FIG. 4, and in perspective view in FIG. 4A, that connects to the lower end 190 of the tubular body 108. Allowing the tubular body 108 to be a single piece design, the stabilizer sub 109 enables the connection between the two to be stronger (due to the ability to withstand higher makeup torque and strength when connected to the drill pipe string) than a conventional two piece tool having an upper and a lower connection. The stabilizer sub 109 provides for more efficient connection to other down hole equipment or tools. The stabilizer sub 109 includes a plurality of stabilizer ribs 109' which extend around the circumference of at least the upper portion of the stabilizer sub 109 in a spiral or helical configuration. If desired, the stabilizer ribs 109' may be located on any portion of the sub 109. The inclusion of the stabilizer ribs 109' on the exterior of the stabilizer sub 109 provides stabilization for the expandable reamer apparatus 100 during the use thereof to reduce wobble and whirl of the expandable reamer apparatus 100 thereby improving the cutting rate effectiveness thereof. The stabilizer sub 109 should be located as close as possible to the expandable reamer apparatus 100, particularly the stabilizer ribs 109' on the stabilizer sub 109, to provide increased stabilization for the expandable reamer apparatus 100 during the use thereof. If desired, more than one stabilizer sub 109 having stabilizer ribs 109' thereon may be used with the expandable reamer apparatus 100 with each stabilizer sub 109 being connected to another stabilizer sub 109. Also, for enhanced stabilization of the expandable reamer apparatus 100, the stabilizer ribs 109' may be used on substantially all the exterior of the stabilizer sub 109, rather than one portion. As stated, the stabilizer ribs 109' wrap spirally or helically around the stabilizer sub 109 to provide a stabilizer rib 109' having a length thereof to provide contact between the stabilizer ribs 109' and the borehole when the expandable reamer apparatus 100 is being used to provide stabilization for the expandable reamer apparatus 100. The diameter of the stabilizer ribs 109' of the stabilizer sub 109 should be substantially under gage of the nominal borehole diameter drilled by a drill bit either by an amount from 0.00 inche less than the nominal borehole diameter to substantially 0.50 inche less than the nominal borehole diameter or substantially under gage of the nominal diameter of the borehole by an amount from substantially 0% less than the nominal borehole diameter to substantially 4% less than the nominal borehole diameter. Preferably, the diameter of the stabilizer ribs 109' of the stabilizer sub 109 should be 0.125 inche (⅛") less than the nominal borehole diameter.

Figure 1A:
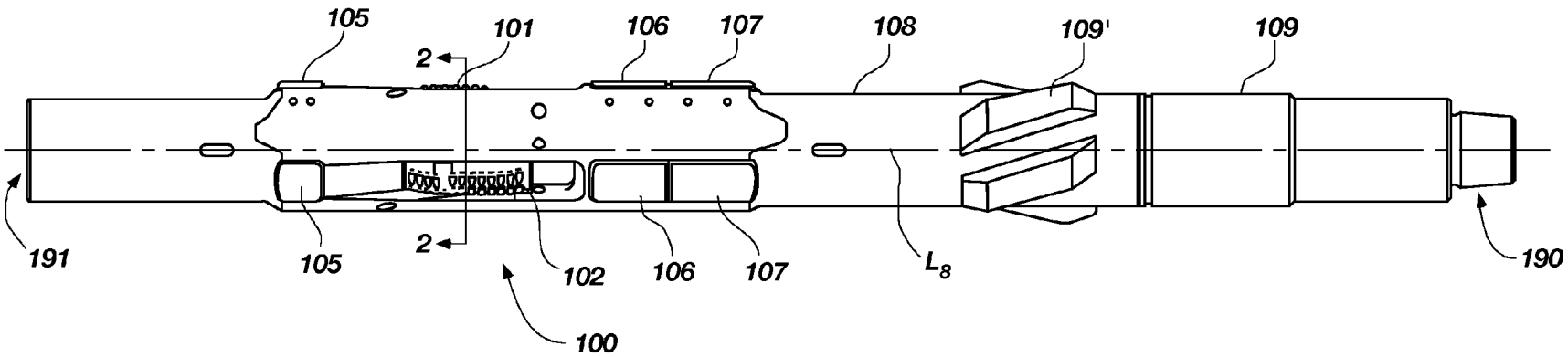
FIG. 1A is a side view of an embodiment of an expandable reamer apparatus having stabilizer ribs thereon.

As an alternative to the use of a sub 109 having stabilizer ribs 109' thereon, the tubular body 108 may be extended in length and stabilizer ribs 109' included on the lower end 190 of tubular body 108. Such an example is illustrated in FIG. 1A. If the stabilizer ribs 109' are placed on the lower end 190 of the tubular body 108, a sub 109 such as illustrated in FIG. 4B is connected to the lower end 190 of the tubular body 108 of expandable reamer apparatus 100. In this manner through the use of a sub, different threads on the end of the stabilizer sub connected to the tubular body 108 may be used having the ability to withstand higher torque when connecting the stabilizer 109 sub with the tubular body 108. For instance, for one size of stabilizer sub 109 and tubular body 108, the threads on the stabilizer sub 109 and the threads of the tubular body 108 are joined using a level of torque for an open drill hole connection while the threads on the stabilizer sub 109 will be joined with the threads of a piece of drill pipe using a substantially lower level of torque.

Figure 4:
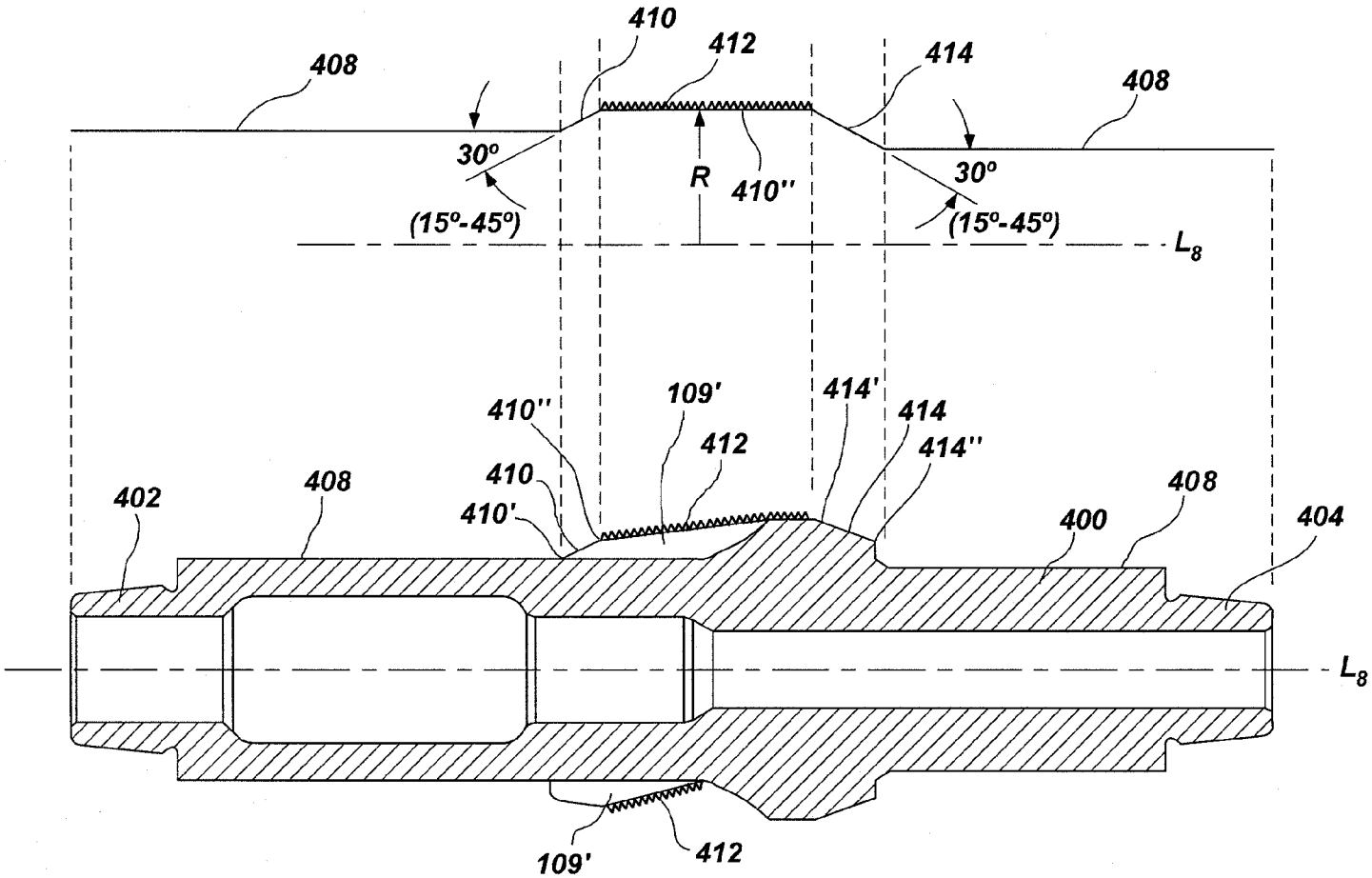
FIG. 4 shows an enlarged longitudinal cross-sectional view of a stabilizer sub used as a portion of the expandable reamer apparatus shown in FIG. 3.

The stabilizer sub 109 is illustrated in cross-section in FIG. 4. The stabilizer sub 109 comprises an elongated cylindrical annular member 400 having a threaded pin 402 on one end thereof having a suitable thread thereon which engages threaded bore 108' on lower end of tubular body 108 (see FIG. 22) and a threaded pin 404 on the other end thereof having a suitable thread thereon, or a threaded box connection therein having a suitable thread 54 therein (as illustrated in FIG. 4F) for engaging drill pipe and the like, an irregular shaped bore 404 extending through the elongated cylindrical annular member 400 for the flow of drilling fluids therethrough, and a cylindrical outer surface 408 having a plurality of spiral stabilizer ribs 109' thereon which can be located at any position desired along the cylindrical outer surface 408 having any length as desired. As illustrated in FIG. 4, the stabilizer ribs 109' are located approximately in the center section of the stabilizer sub 109, although they may be located at any desired location thereon, such as adjacent the upper end, adjacent the lower end, and the like. Each stabilizer rib 109' extends spirally or helically around the cylindrical outer surface 408 of the stabilizer sub 109 for substantially 45° (degrees) or more or any desired extent or number or degrees around the circumference of the cylindrical outer surface 408 to provide a series of stabilizer ribs 109' capable of substantially continuously engaging the formation being reamed during operation of the expandable reamer apparatus 100 so that a stabilizer rib 109' contacts the borehole being reamed. If desired, the stabilizer ribs 109' may extend around the cylindrical outer surface 408 for 180° or more of the circumference of the stabilizer sub 109, such as 360° circumference of the stabilizer sub 109.

Figure 4A:
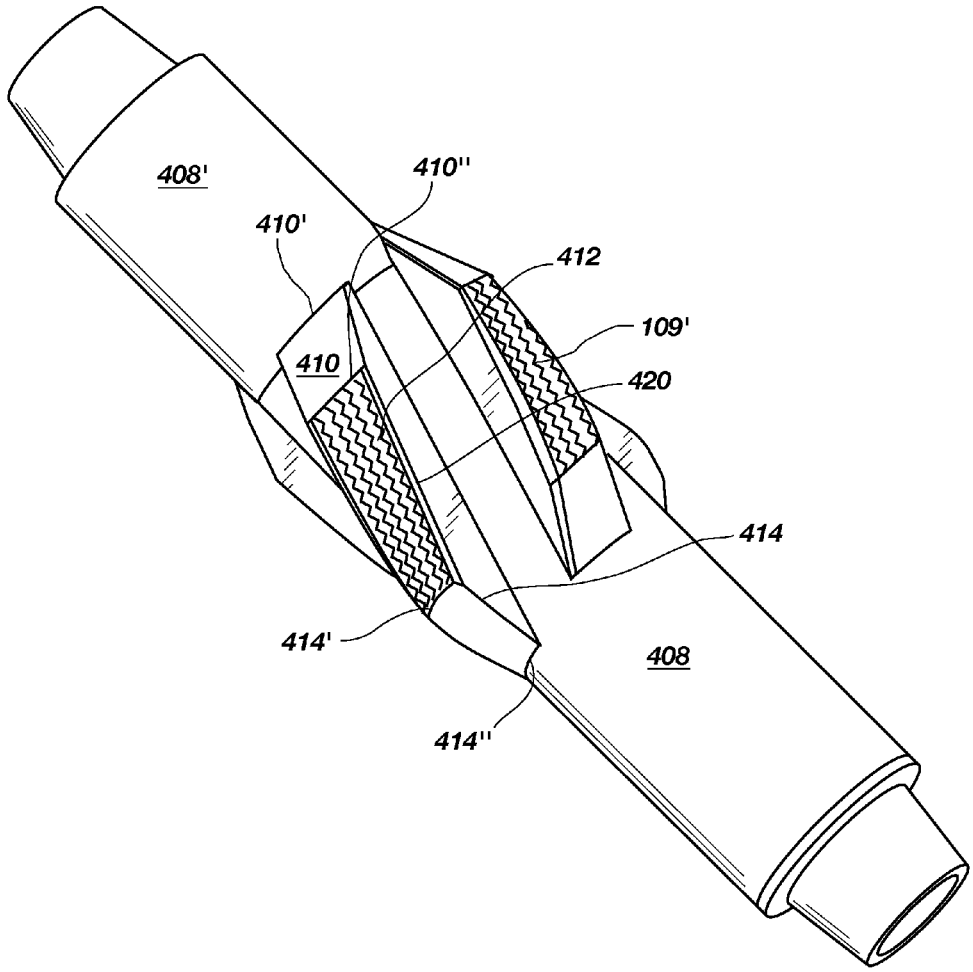
FIG. 4A is a perspective view of the lower stabilizer sub used as a portion of the expandable reamer apparatus shown in FIG. 3.
Figure 4B:
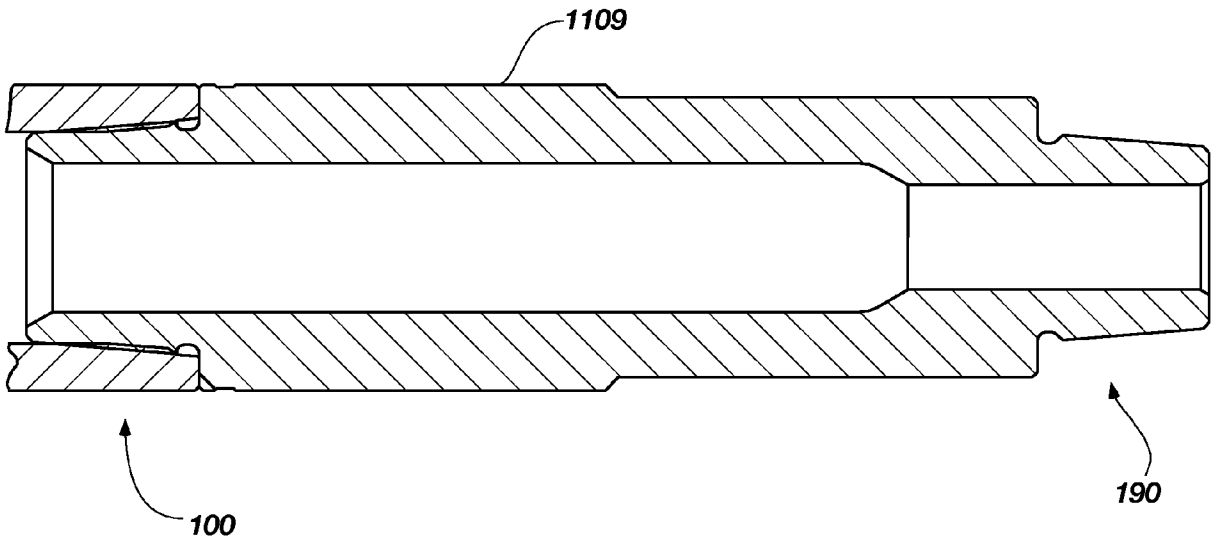
FIG. 4B shows an enlarged longitudinal cross-sectional view of a lower sub used as a portion of the expandable reamer apparatus shown in FIG. 3.

As illustrated in FIGS. 4 and 4A, each stabilizer blade 109' includes a first arcuate beveled surface 410 increasing from a first diameter 410' substantially the same as the diameter of the cylindrical outer surface 408 at substantially a thirty degree (30°) angle, although the angle may vary in the range of 15° to 45°, if desired, extending up to a second diameter 410" which is larger than the first diameter 410', the surface 412 of hardfacing is formed on the second diameter 410" that is located at a constant radius R from the center line $L_8$ of the stabilizer sub 109, a second arcuate beveled surface 414 having a first diameter 414' substantially the same or equal to the to the diameter 410" of the first arcuate beveled surface 410 at substantially a thirty degree (30°) angle down to a second diameter 414" substantially equal to the diameter of the surface 408' of the outer surface of the lower end of the sub 109. Each stabilizer rib 109' includes suitable hardfacing 412 on the exterior thereof. The shape of the stabilizer ribs 109' and the under gage diameter thereof cause the stabilizer sub 109 to effectively engage portions of a bore hole in which the stabilizer sub 109 is connected to the expandable reamer apparatus 100 to stabilize the expandable reamer apparatus 100 during the operation thereof. The stabilizer sub 109 should be directly connected to the expandable reamer apparatus 100 without any other connection subs or drill pipes located in between the expandable reamer apparatus 100 and the stabilizer sub 109. For most situations, a location of the stabilizer ribs 109' of the stabilizer sub 109 is having the upper portions of the stabilizer ribs 109' being at a location of approximately two (2) feet from the lower end 190 of the tubular body 108 of the expandable reamer apparatus 100 where the stabilizer sub 109 is connected to the expandable reamer apparatus 100 or within approximately four (4) feet to ten (10) feet of the blades 102 of the expandable reamer apparatus 100.

If a stabilizer sub 109 is not to be run with the expandable reamer apparatus 100, a lower sub 1109 shown in FIG. 4B that connects to the lower end 190 of the tubular body 108 (FIG. 1) may be used. Allowing the tubular body 108 to be a single piece design, the sub 1109 enables the connection between the two to be stronger (due to the ability to withstand higher makeup torque with the tubular housing 108 as described herein) than a conventional two piece tool having an upper and a lower connection. The stabilizer sub 109 or sub 1109, although not required, provides for more efficient connection to other downhole equipment or tools.

Figure 4C:
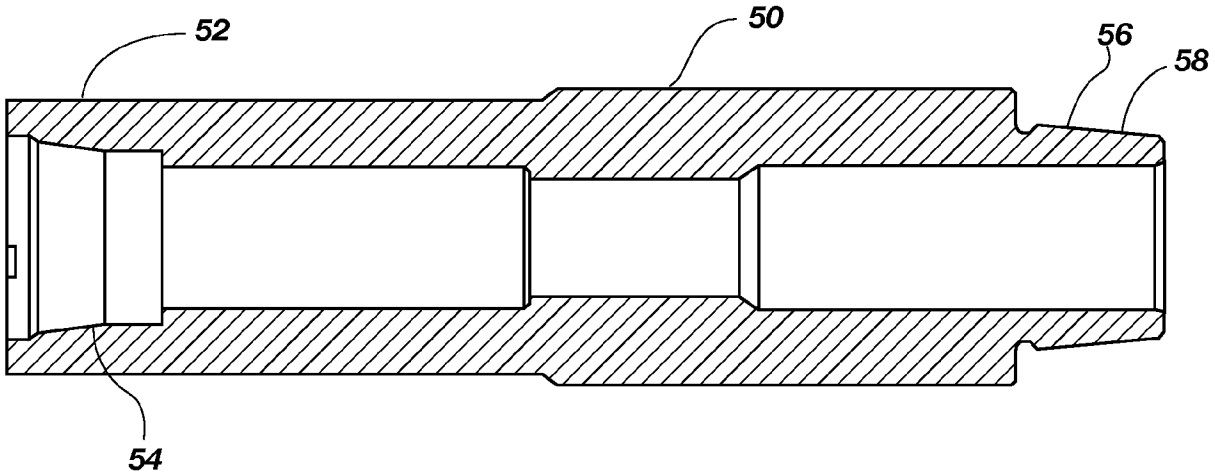
FIG. 4C shows an enlarged longitudinal cross-sectional view of an upper stabilizer sub used as a portion of the expandable reamer apparatus shown in FIG. 3.

Additionally, an upper stabilizer sub 50 shown in FIG. 4C may be used to connect to the upper box connection of the tubular body 108. Allowing the tubular body 108 to be a single piece design, the upper stabilizer sub 50 enables the connection between the tubular housing 108 and the sub 50 to be stronger (has the ability to withstand higher makeup torque with the sub 50 and the tubular housing 108 as described herein) than a conventional two piece tool having an upper and a lower connection. The upper stabilizer sub 109, although not required, provides for more efficient connection to other downhole equipment or tools and the drill pipe string. The upper stabilizer sub 50 includes an upper box end 52 having any desired threads 54 (not depicted) therein and a lower pin end 56 having any desired threads 58 (not depicted) thereon to mate with the upper box connection of the tubular body 108.

Figure 4D:
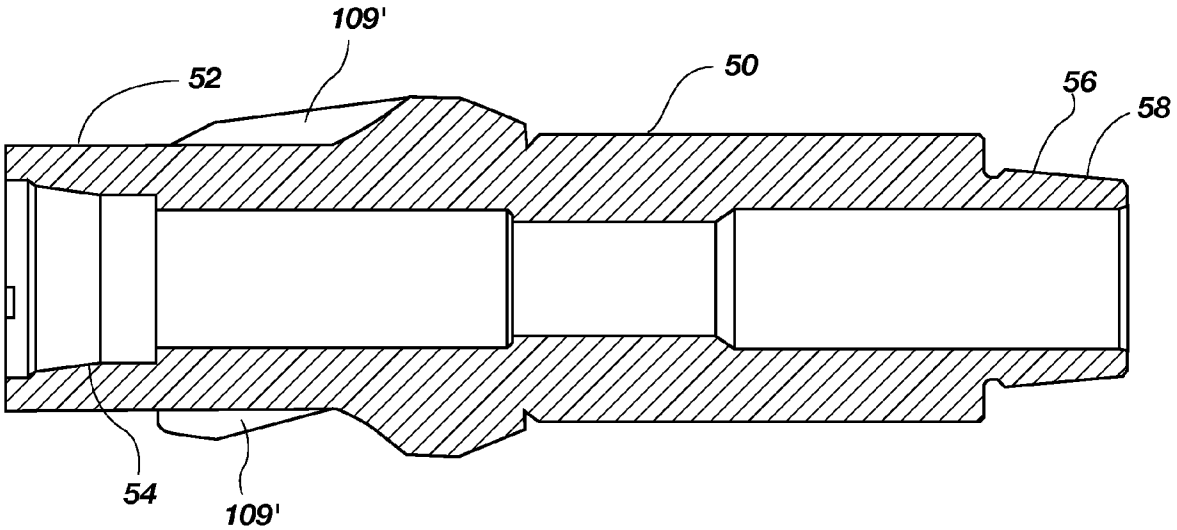
FIG. 4D shows an enlarged longitudinal cross-sectional view of an upper stabilizer sub used as a portion of the expandable reamer apparatus shown in FIG. 3.

Additionally, if desired, the upper stabilizer sub 50 shown in FIG. 4D may have stabilizer ribs 109' as described herein to be used to stabilize the expandable reamer apparatus 100. The upper stabilizer sub 50 is to be used to connect to the upper box connection of the tubular body 108. Allowing the tubular body 108 to be a single piece design, the upper stabilizer sub 50 enables the connection between the sub 50 and tubular housing 108 as described herein than a conventional two piece tool having an upper and a lower connection. The upper stabilizer sub 109, although not required, provides for more efficient connection to other downhole equipment or tools and the drill pipe string. The upper stabilizer sub 50 includes an upper box end 52 having any desired threads 54 therein and a lower pin end 56 having any desired threads 58 thereon to mate with the upper box connection of the tubular body 108.

Figure 4E:
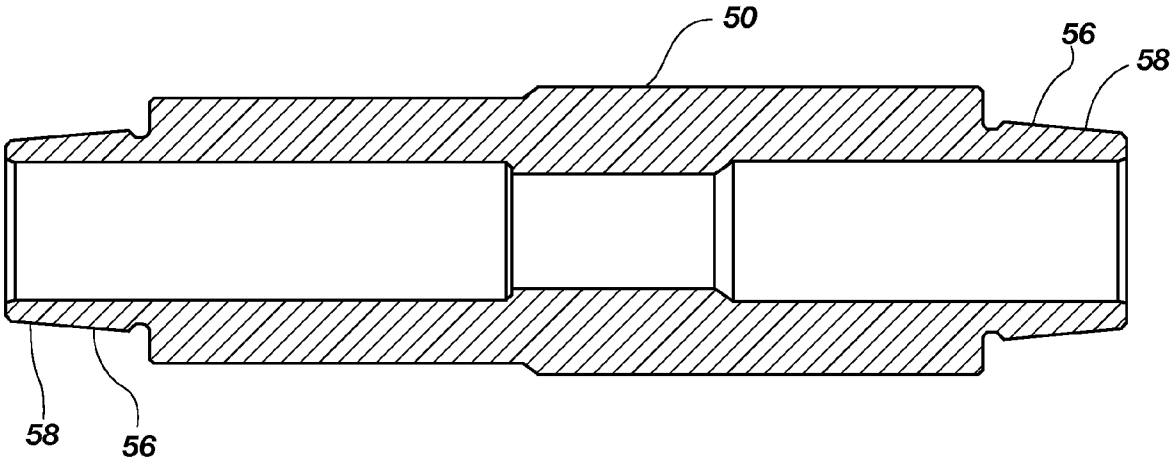
FIG. 4E shows an enlarged longitudinal cross-sectional view of an upper stabilizer sub used as a portion of the expandable reamer apparatus shown in FIG. 3.
Figure 4F:
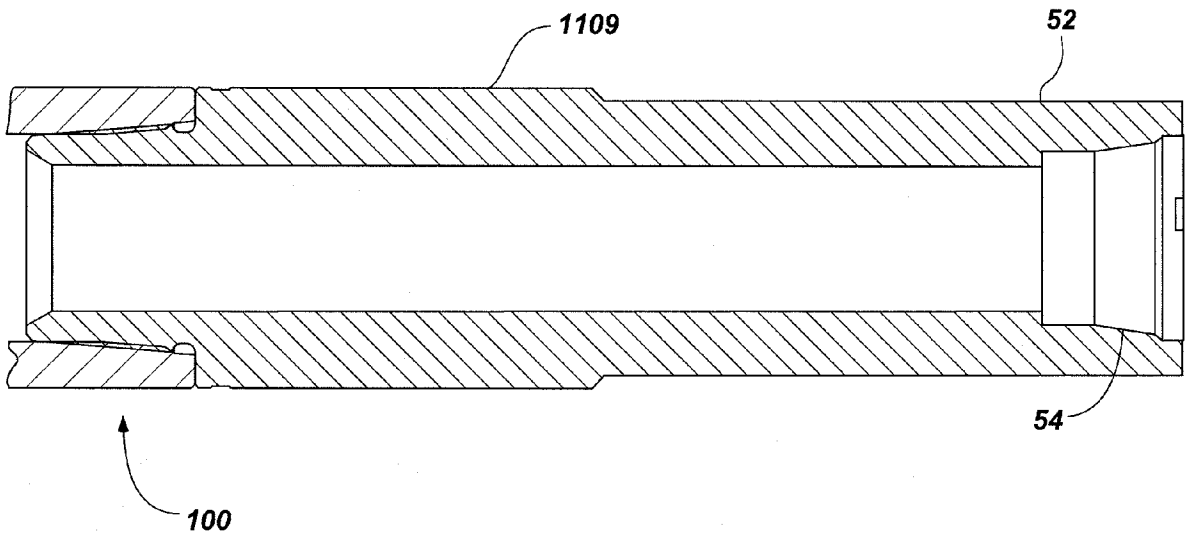
FIG. 4F shows an enlarged longitudinal cross-sectional view of a lower sub used as a portion of the expandable reamer apparatus shown in FIG. 3.

If desired, the upper sub 50 may have pin end 56 having any desired threads 58 thereon on both ends thereof as illustrated in FIG. 4E.

Similarly, the lower sub 1109 may have box end 52 having any desired threads 54 therein on the lower end thereof as illustrated in FIG. 4F.

Figure 4G:
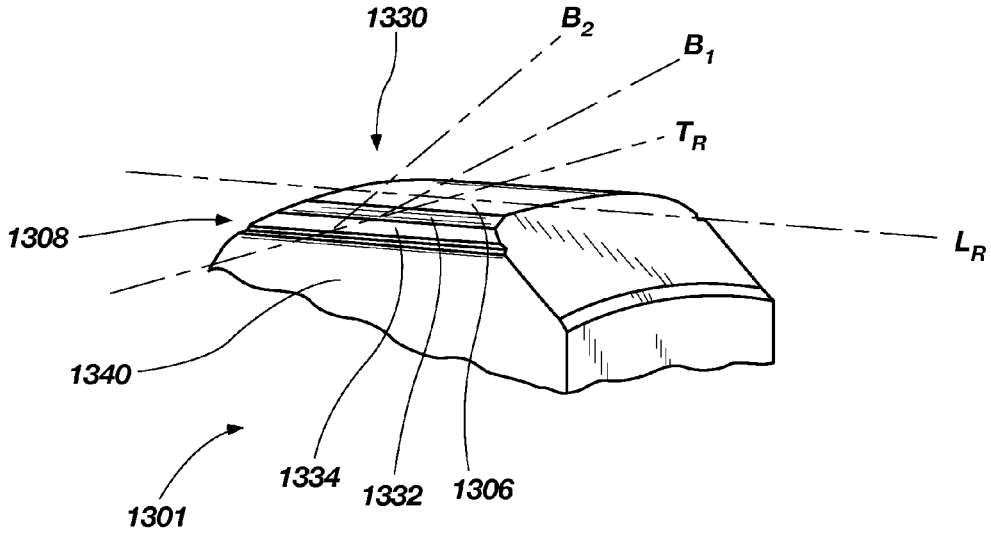
FIG. 4G is a view of a portion of a stabilizer rib for a stabilizer sub used as a portion of the expandable reamer apparatus shown in FIG. 3.
Figure 4H:
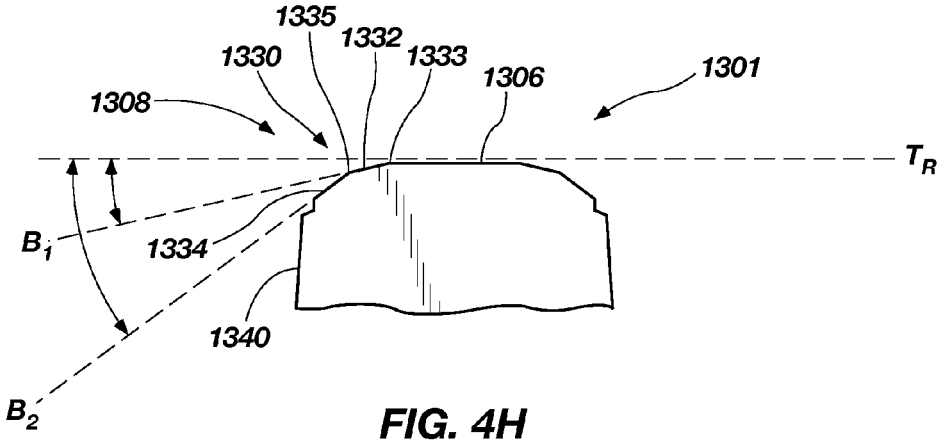
FIG. 4H is a view of a portion of a stabilizer rib for a stabilizer sub used as a portion of the expandable reamer apparatus shown in FIG. 3.

Embodiments of the stabilizer may include a stabilizer rib, having a compound engagement profile on its rotational leading edge in order to improve rotational stability of a drilling assembly while drilling. Such a compound engagement profile is described in U.S. patent application Ser. No. 12/416,386, filed Apr. 1, 2009, the disclosure of which is incorporated herein in its entirety. As shown in FIG. 4G, a stabilizer rib 1301 includes a bearing surface 1306 and a compound engagement profile 1330 on a rotational leading edge 1308. The stabilizer rib 1301, as shown in this embodiment herein is for use with an expandable stabilizer. Reference may also be made to FIG. 4H showing a partial cross-sectional view of the stabilizer rib 1301. The compound engagement profile 1330 in this embodiment comprises a compound bevel that includes a first bevel surface 1332 and a second bevel surface 1334. The first bevel surface 1332 provides for a smooth, non-aggressive lead-in angle (the angle shown between tangential reference line $T_R$ of the bearing surface 1306 and the bevel reference line $B_1$) relative to the bearing surface 1306 of the stabilizer rib 1301, while the second bevel surface 1334 provides transition between a leading face 1340 and the first bevel surface 1332 of stabilizer blade 1301 as the stabilizer rib 1301 comes into contact with a formation. The second bevel surface 1334 has a steeper lead-in angle (the angle shown between tangential reference line $T_R$ of the bearing surface 1306 and the bevel reference line $B_2$) relative to the first bevel surface 1332. The bevel surfaces 1332 and 1334 extend longitudinally between the leading edge 1308 and the bearing surface 1306 of the stabilizer rib 1301 and include angles of about 15 and 45 degrees, respectively (i.e., the angle between reference lines $B_1$ and $T_R$ is 15 degrees and the angle between reference lines $B_1$ and $B_2$ is 30 degrees). However, other suitable included angles greater or lesser than the 15 and 45 degrees described may be employed. The tangential reference line $T_R$ is perpendicular to the longitudinal axis as referenced by $L_R$ and is tangential to the bearing surface 1306.

The bearing surface 1306 is convex or arcuate in shape, having a radius of curvature substantially configured to conform to an inner radius of a borehole (i.e., the so called "gage OD" of the stabilizer). Optionally, the bearing surface 1306 may be convexly shaped to a greater or lesser extent than shown, or may be substantially flat relative to the tangential reference line $T_R$.

The first bevel surface 1332 is substantially linear while providing transition between the second bevel surface 1334 and the bearing surface 1306 for reducing vibrational engagement when contacting a wall of a borehole. Similarly, the second bevel surface 1334 is substantially linear to provide transition between the leading face 1340 and the first bevel surface 1332 of the rib 1301. Advantageously, the second bevel surface 1334, the first bevel surface 1332, or both, help to reduce the tendency of the drill string to whirl by progressively providing, as necessitated, transitional contact with the material of a subterranean formation delineating a wall of a borehole as a stabilizer is rotated therein. Optionally, either the first bevel surface 1332, the second bevel surface 1334, or both, may have a curvilinear shape, e.g., convex or arcuate. The transition between the second bevel surface 1334, the first bevel surface 1332 and the bearing surface 1306 may be continuous or may include discrete transitions as illustrated by inflection points 1335 and 1333, respectively, between surfaces.

By providing enhanced stabilization, a stabilizer may incorporate the compound engagement profile 1330 upon one or more of the ribs making up the stabilizer. Where the compound engagement profile 1330 is included upon less than all the ribs forming the stabilizer, the compound engagement profile 1330 may be included upon the ribs in symmetric or asymmetric fashion.

It is further recognized that a greater number of bevel surfaces than the first and second bevel surface 1332 and 1334, respectively, may be provided, where each additional bevel surface includes a progressively steeper lead-in angle relative to any one of the preceding bevel surfaces between it and the bearing surface 1306.

By providing a compound engagement profile 1330 upon the stabilizer rib 1301, a pronounced improvement over conventional stabilizers is achieved, particularly when compared with expandable stabilizers having conventional profiles. Conventional stabilizer ribs and blades include leading edges that are rectangular in profile having a sharp corner or pronounced bevel, such as a 45 degree bevel, which is particularly aggressive when encountering irregularities in the borehole of the subterranean formation like swelled shale as mentioned hereinabove. Increased stability, and reduced whirl and lateral vibration is achieved by providing the compound engagement profile 1330 that provides rotational transition between the bearing surface 1306 of a stabilizer rib 1301 with the subterranean formation and further helps to reduce other undesirable effects such as bit whirl. By reducing the propensity of a stabilizer to the effects of whirl; lateral vibrations are also diminished.

Figure 4I:
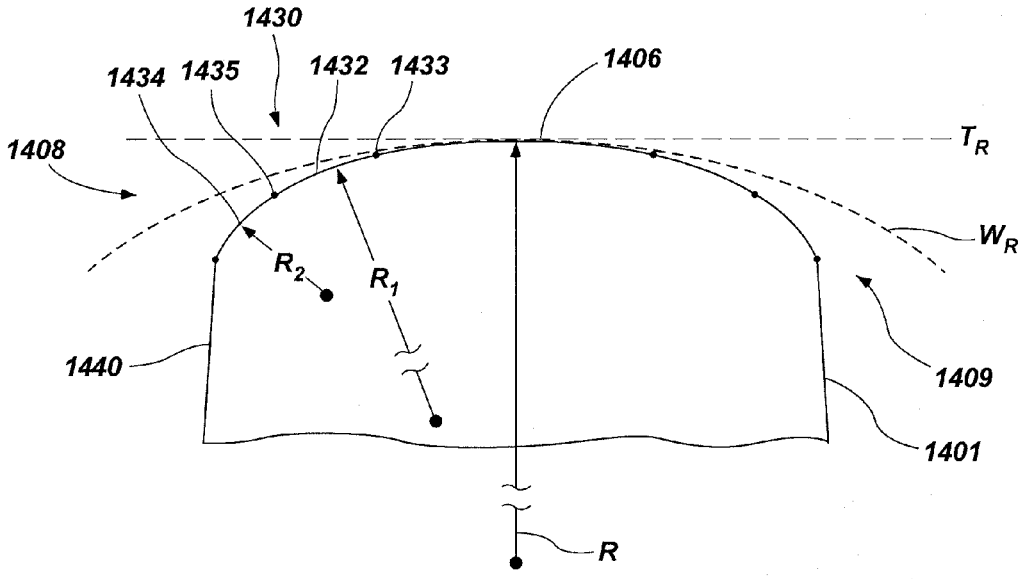
FIG. 4I is a view of a portion of a stabilizer rib for a stabilizer sub used as a portion of the expandable reamer apparatus shown in FIG. 3.

In another embodiment as shown in FIG. 4I, a stabilizer rib 1401 of a stabilizer (not shown) includes a compound engagement profile 1430 on its rotational leading edge 1408 in order to improve rotational stability of down hole equipment when rotationally engaging a wall of a borehole as denoted by Arabic reference $W_R$. It is also recognized that the profile 1430 may be provided on a rotationally opposite edge 1409, which is suitable for a rib 1401 that may be oriented in one of two directions when assembled with a stabilizer. As shown, the stabilizer rib 1401 includes a bearing surface 1406 and the compound engagement profile 1430, where the stabilizer rib 1401 may be used on expandable or fixed types of stabilizer assemblies. The compound engagement profile 1430 in this embodiment herein is a compound arcuate bevel that includes a first arcuate surface 1432 and a second arcuate surface 1434. The first arcuate surface 1432 provides for a smooth, non-aggressive continuous transition surface (curvature illustrated by radius of curvature $R_1$) leading onto, relatively, the bearing surface 1406 of the stabilizer rib 1401, while the second arcuate surface 1434 provides transition between a leading face 1440 and the first arcuate surface 1432 or the bearing surface 1406, or both, as the stabilizer rib 1401 comes into contact with a formation. The second arcuate surface 1434 has a steeper (i.e., smaller) radius of curvature $R_2$ relative to the first arcuate surface 1432 to provide further transitional engagement onto the bearing surface 1406 as the stabilizer rib 1401 engages a formation. The arcuate surfaces 1432 and 1434 extend continuously between the leading edge 1408 and the bearing surface 1406 of the stabilizer rib 1401 and include smaller successive radiuses of curvature relative to the bearing surface 1406, respectively. However, other suitable radiuses of curvature smaller in extent than the effective radius R of the bearing surface 1406 may be employed. A tangential reference line $T_R$ is provided to illustrate the ideal engagement between the stabilizer rib 1401 with the borehole wall $W_R$. The tangential reference line $T_R$ is perpendicular to the longitudinal axis L of the stabilizer and substantially tangential to a portion of the bearing surface 1406.

It is to be recognized that while the bearing surface 1406 includes an arcuate shape having a radius of curvature R substantially configured to conform to an inner radius of a borehole (i.e., the so called "gage OD" of the stabilizer), the bearing surface may be flat or include another shaped profile suitable for engaging the wall of a borehole.

Optionally, the transition between the second arcuate surface 1434, the first arcuate surface 1432 and the bearing surface 1406 may be abrupt enough to be visually perceptible as illustrated by transition points 1435 and 1433, respectively, therebetween.

It is further recognized that a greater number of arcuate surfaces than the first and second arcuate surface 1432 and 1434 may be provided, respectively, where each additional arcuate surface includes a progressively smaller radius of curvature relative to any one of the preceding arcuate surfaces between it and the bearing surface 1406.

The tubular body 108 of the expandable reamer apparatus 100 may have a lower end 190 and an upper end 191. The terms "lower" and "upper," as used herein with reference to the ends 190, 191, refer to the typical positions of the ends 190, 191 relative to one another when the expandable reamer apparatus 100 is positioned within a well bore. The lower end 190 of the tubular body 108 of the expandable reamer apparatus 100 may include a set of threads (e.g., a threaded male pin member) for connecting the lower end 190 to another section of a drill string or another component of a bottomhole assembly (BHA), such as, for example, a drill collar or collars carrying a pilot drill bit for drilling a well bore and for connection to the stabilizer sub 109 or sub 1109, preferably for connection to the stabilizer sub 109 and sub 1109. Similarly, the upper end 191 of the tubular body 108 of the expandable reamer apparatus 100 may include a set of threads (e.g., a threaded female box member) for connecting the upper end 191 to another section of a drill string or another component of a bottomhole assembly (BHA). The threads in the lower end 190 can be of any suitable type for mating with another section of a drill string or another component of a bottomhole assembly (BHA), such as, for example, a drill collar or collars carrying a pilot drill bit for drilling a well bore and for connection to the stabilizer sub 109 or sub 1109.

Figure 17:
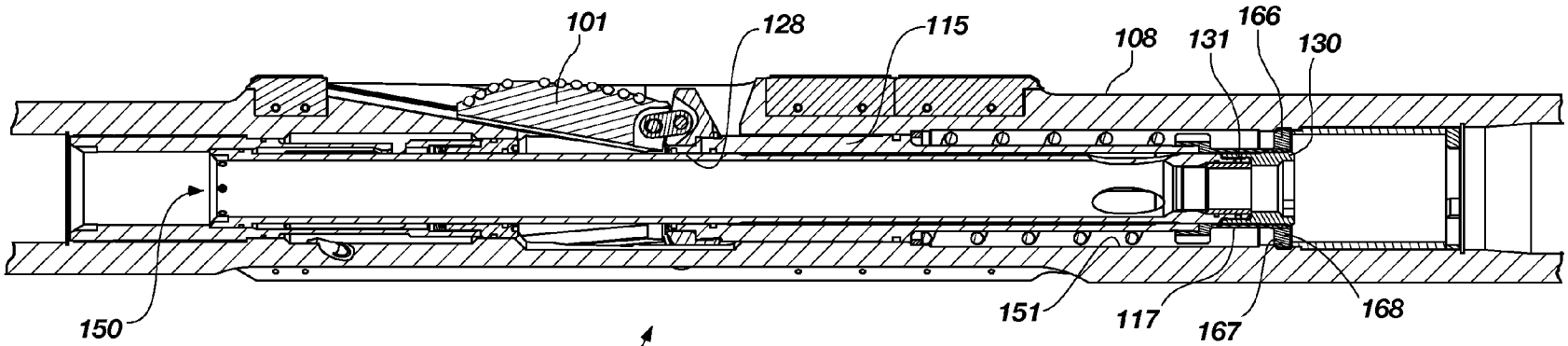
FIG. 17 shows a partial, longitudinal cross-sectional illustration of an embodiment of the expandable reamer apparatus in a closed, or retracted, initial tool position.

Three sliding cutter blocks or blades 101, 102, 103 (see FIG. 2) are positionally retained in circumferentially spaced relationship in the tubular body 108 as further described below and may be provided at a position along the expandable reamer apparatus 100 intermediate the first lower end 190 and the second upper end 191. The blades 101, 102, 103 may be comprised of steel, tungsten carbide, a particle-matrix composite material (e.g., hard particles dispersed throughout a metal matrix material), or other suitable materials as known in the art. The blades 101, 102, 103 are retained in an initial, retracted position within the tubular body 108 of the expandable reamer apparatus 100 as illustrated in FIG. 17, but may be moved responsive to application of hydraulic pressure into the extended position (shown in FIG. 22) and moved into a retracted position (shown in FIG. 23) when desired, as will be described herein. The expandable reamer apparatus 100 may be configured such that the blades 101, 102, 103 engage the walls of a subterranean formation surrounding a well bore in which the expandable reamer apparatus 100 is disposed to remove formation material when the blades 101, 102, 103 are in the extended position, but are not operable to so engage the walls of a subterranean formation within a well bore when the blades 101, 102, 103 are in the retracted position. While the expandable reamer apparatus 100 includes three blades 101, 102, 103, it is contemplated that one, two or more than three blades may be utilized to advantage. Moreover, while the blades 101, 102, 103 are symmetrically circumferentially positioned axial along the tubular body 108, the blades 101, 102, 103 may also be positioned circumferentially asymmetrically as well as asymmetrically along the longitudinal axis $L_8$ in the direction of either end 190 and 191.

Figure 2:
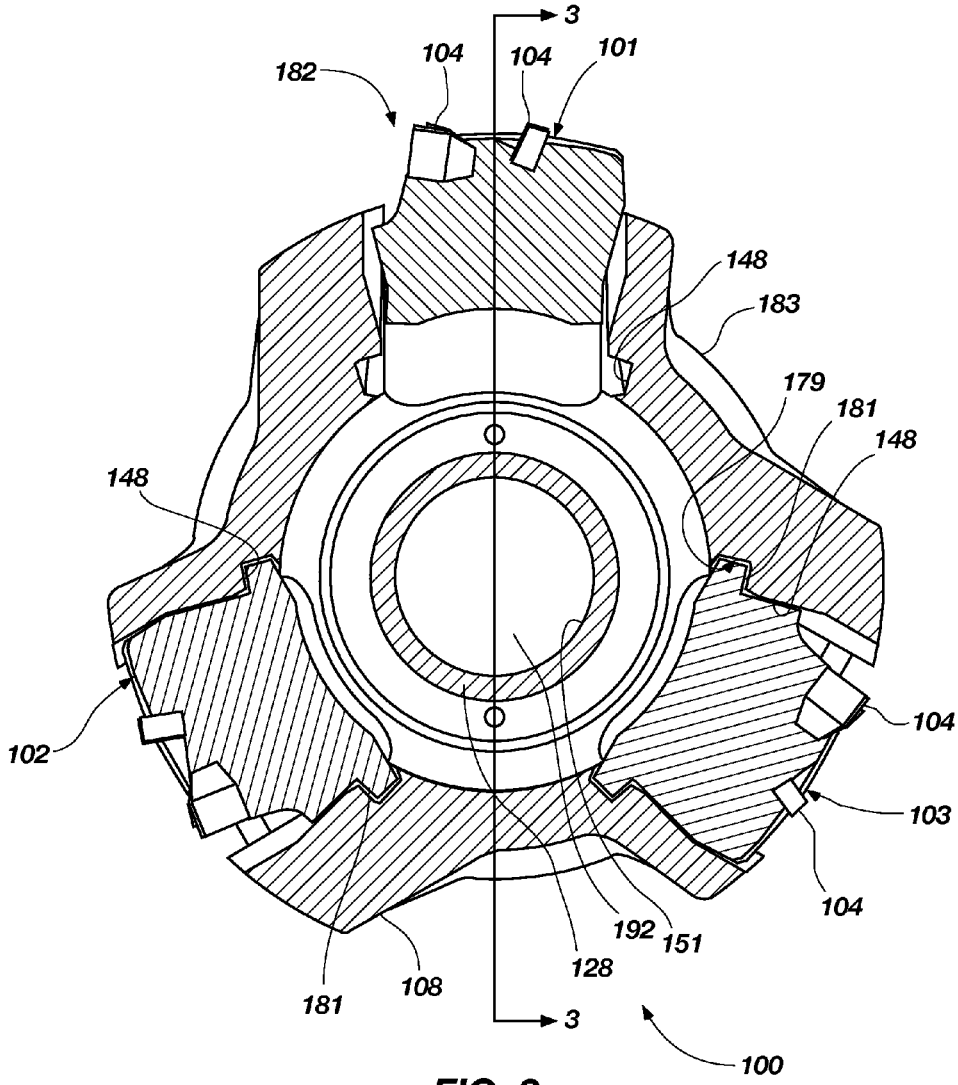
FIG. 2 shows a transverse cross-sectional view of the expandable reamer apparatus as indicated by section line 2-2 in FIG. 1.

FIG. 2 is a cross-sectional view of the expandable reamer apparatus 100 shown in FIG. 1 taken along section line 2-2 shown therein. As shown in FIG. 2, the tubular body 108 encloses a fluid passageway 192 that extends longitudinally through the tubular body 108. The fluid passageway 192 directs fluid substantially through an inner bore of a traveling sleeve 128 in bypassing relationship to substantially shield the blades 101, 102, 103 from exposure to drilling fluid, particularly in the lateral direction, or normal to the longitudinal axis $L_8$. Advantageously, the particulate-entrained fluid is less likely to cause build-up or interfere with the operational aspects of the expandable reamer apparatus 100 by shielding the blades 101, 102, 103 from exposure with the fluid. However, it is recognized that beneficial shielding of the blades 101, 102, 103 is not necessary to the operation of the expandable reamer apparatus 100 where, as explained in further detail below, the operation, i.e., extension from the initial position, the extended position and the retracted position, occurs by an axially directed force that is the net effect of the fluid pressure and spring biases forces. In this embodiment, the axially directed force directly actuates the blades 101, 102, 103 by axially influencing the actuating means, such as a push sleeve 115 (shown in FIG. 3) for example, and without limitation, as better described herein below.

Referring to FIG. 2, to better describe aspects, blades 102 and 103 are shown in the initial or retracted positions, while blade 101 is shown in the outward or extended position. The expandable reamer apparatus 100 may be configured such that the outermost radial or lateral extent of each of the blades 101, 102, 103 is recessed within the tubular body 108 when in the initial or retracted positions so it may not extend beyond the greatest extent of outer diameter of the tubular body 108. Such an arrangement may protect the blades 101, 102, 103 as the expandable reamer apparatus 100 is disposed within a casing of a borehole, and may allow the expandable reamer apparatus 100 to pass through such casing within a borehole. In other embodiments, the outermost radial extent of the blades 101, 102, 103 may coincide with or slightly extend beyond the outer diameter of the tubular body 108. As illustrated by blade 101, the blades may extend beyond the outer diameter of the tubular body 108 when in the extended position, to engage the walls of a borehole in a reaming operation.

Figure 3:
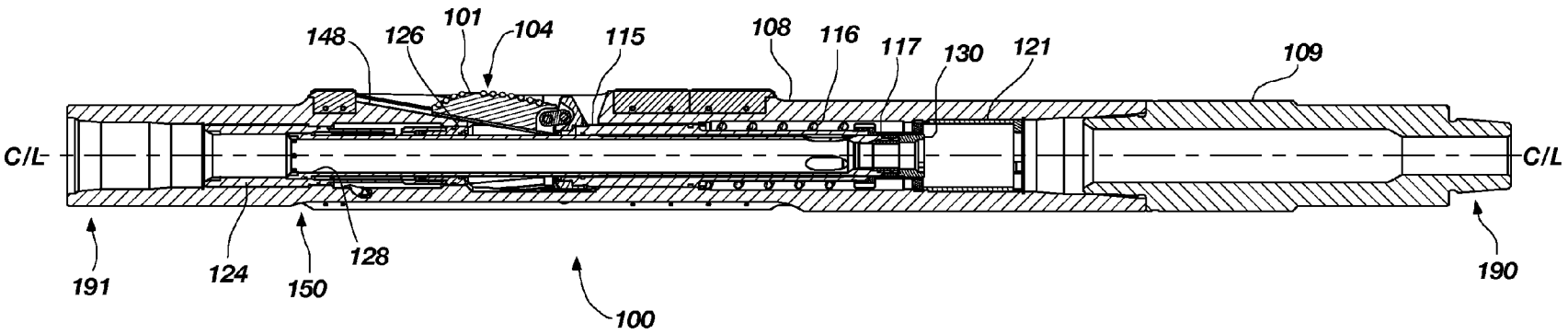
FIG. 3 shows a longitudinal cross-sectional view of the expandable reamer apparatus shown in FIG. 1.

FIG. 3 is another cross-sectional view of the expandable reamer apparatus 100 shown in FIGS. 1 and 2 taken along section line 3-3 shown in FIG. 2. Reference may also be made to FIGS. 4-7, which show enlarged partial longitudinal cross-sectional views of various portions of the expandable reamer apparatus 100 shown in FIG. 3. Reference may also be made back to FIGS. 1 and 2 as desired. The tubular body 108 positionally respectively retains three sliding cutter blocks or blades 101, 102, 103 in three blade tracks 148. The blades 101, 102, 103 each carry a plurality of cutting elements 104 for engaging the material of a subterranean formation defining the wall of an open borehole when the blades 101, 102, 103 are in an extended position (shown in FIG. 22). The cutting elements 104 may be polycrystalline diamond compact (PDC) cutters or other cutting elements known to a person of ordinary skill in the art and as generally described in U.S. Pat. No. 7,036,611 entitled "Expandable Reamer Apparatus for Enlarging Boreholes while Drilling and Methods of Use," the entire disclosure of which is incorporated herein.

Figure 8:
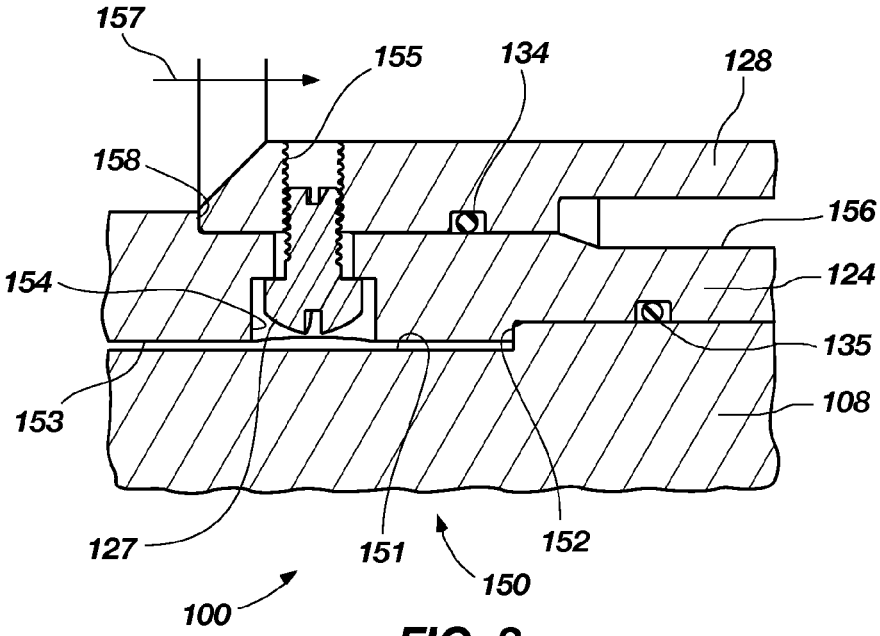
FIG. 8 shows a cross-sectional view of a shear assembly of an embodiment of the expandable reamer apparatus.

The expandable reamer apparatus 100 includes a shear assembly 150 for retaining the expandable reamer apparatus 100 in the initial position by securing the traveling sleeve 128 toward the upper end 191 thereof. Reference may also be made to FIG. 8, showing a partial view of the shear assembly 150. The shear assembly 150 includes an uplock sleeve 124, some number of shear screws 127 and the traveling sleeve 128. The uplock sleeve 124 is retained within an inner bore 151 of the tubular body 108 between a lip 152 and a retaining ring 132 (shown in FIG. 7), and includes an O-ring seal 135 to prevent fluid from flowing between the outer bore 153 of the uplock sleeve 124 and the inner bore 151 of the tubular body 108. The uplock sleeve 124 includes shear slots 154 for retaining each of the shear screws 127, where, in the current embodiment, each shear screw 127 is threaded into a shear port 155 of the traveling sleeve 128. The shear screws 127 hold the traveling sleeve 128 within the inner bore 156 of the uplock sleeve 124 to conditionally prevent the traveling sleeve 128 from axially moving in a downhole direction 157, i.e., toward the lower end 190 of the expandable reamer apparatus 100. The uplock sleeve 124 includes an inner lip 158 to prevent the traveling sleeve 128 from moving in the uphole direction 159, i.e., toward the upper end 191 of the expandable reamer apparatus 100. An O-ring seal 134 seals the traveling sleeve 128 between the inner bore 156 of the uplock sleeve 124. When the shear screws 127 are sheared, the traveling sleeve 128 is allowed to axially travel within the tubular body 108 in the downhole direction 157. Advantageously, the portions of the shear screws 127 when sheared are retained within the uplock sleeve 124 and the traveling sleeve 128 in order to prevent the portions from becoming loose or being lodged in other components when drilling the borehole. While shear screws 127 are shown, other shear elements may be used to advantage, for example, without limitation, a shear rod, a shear wire and a shear pin. Optionally, other shear elements may include structures for positive retention within constituent components after being exhausted, similar in manner to the shear screws 127 of the current embodiment.

Figure 6:
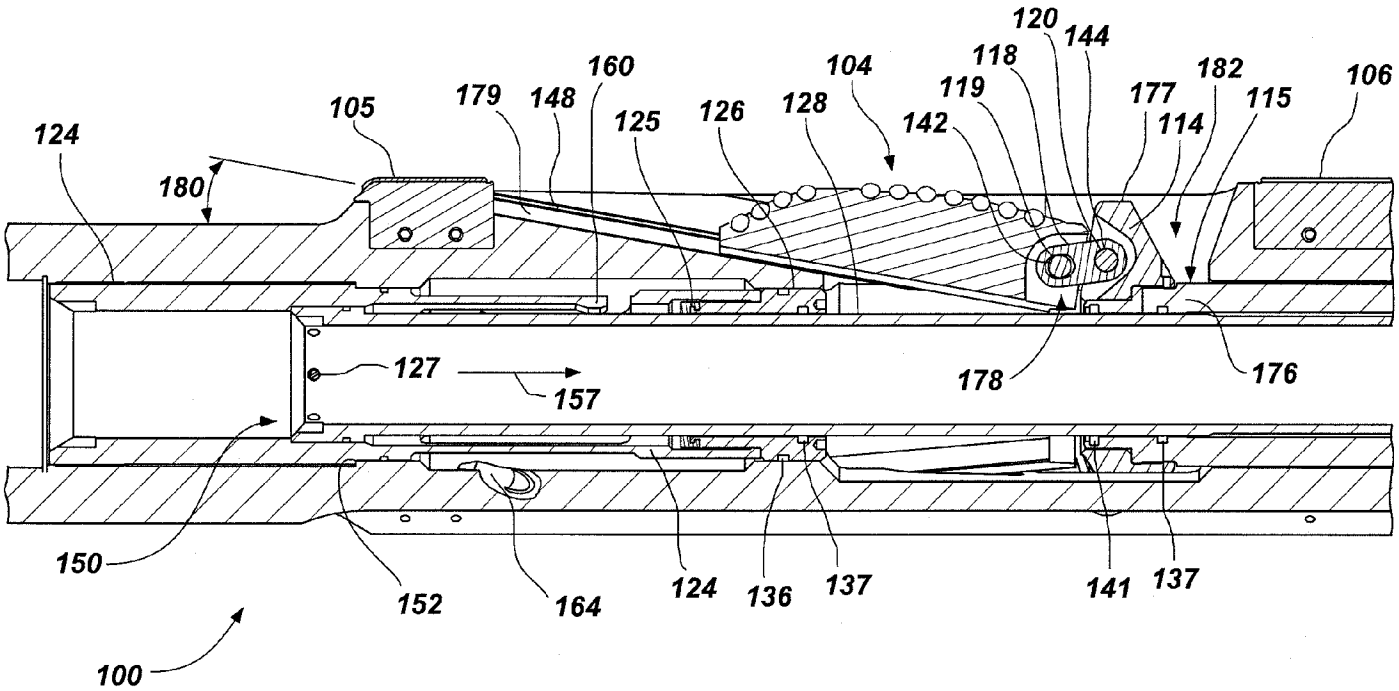
FIG. 6 shows an enlarged cross-sectional view of yet another portion of the expandable reamer apparatus shown in FIG. 3.
Figure 7:
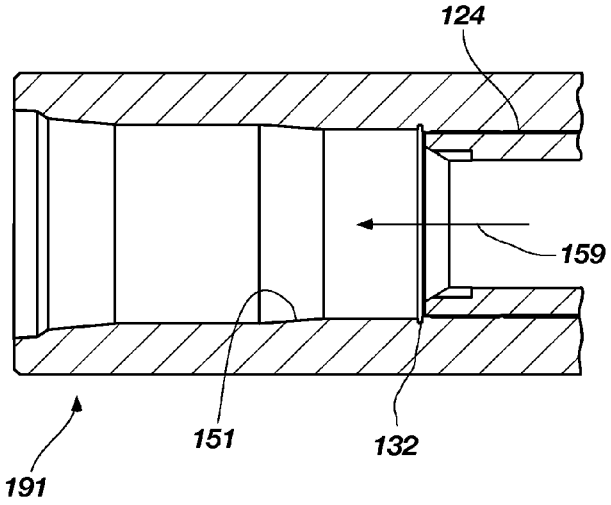
FIG. 7 shows an enlarged cross-sectional view of a further portion of the expandable reamer apparatus shown in FIG. 3.
Figure 15:
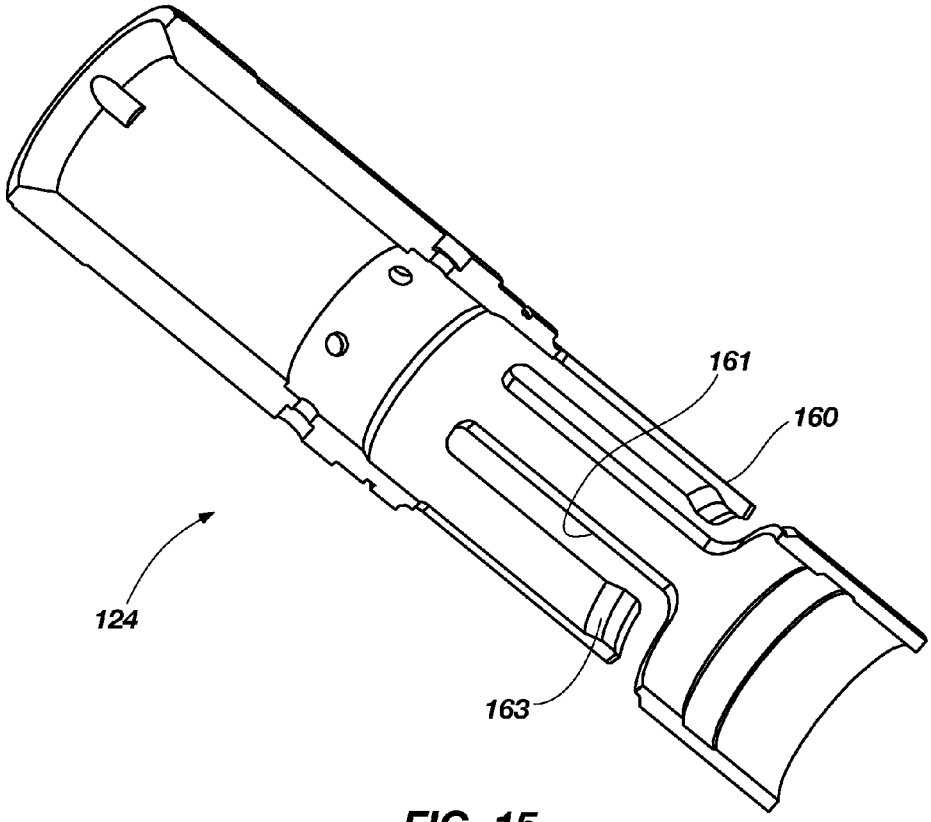
FIG. 15 shows a cross-sectional view of an uplock sleeve of an embodiment of the expandable reamer apparatus.

With reference to FIG. 6, uplock sleeve 124 further includes a collet 160 that axially retains a seal sleeve 126 between the inner bore 151 of the tubular body 108 (FIG. 2) and an outer bore 162 of the traveling sleeve 128. The uplock sleeve 124 also includes one or more ears 163 and one or more ports 161 axially spaced there around (FIG. 15). When the traveling sleeve 128 positions a sufficient axial distance in downhole direction 157, the one or more ears 163 spring radially inward to lock the motion of the traveling sleeve 128 between the one or more ears 163 of the uplock sleeve 124 and between a shock absorbing member 125 mounted upon an upper end of the seal sleeve 126. Also, as the traveling sleeve 128 positions a sufficient axial distance in the downhole direction 157, the one or more ports 161 of the uplock sleeve 124 are fluidly exposed allowing fluid to communicate with a nozzle intake port 164 from the fluid passageway 192. The shock absorbing member 125 of the seal sleeve 126 provides spring retention of the traveling sleeve 128 with the one or more ears 163 of the uplock sleeve 124 and also mitigates impact shock caused by the traveling sleeve 128 when its motion is stopped by the seal sleeve 126.

Shock absorbing member 125 may comprise a flexible or compliant material, such as, for instance, an elastomer or other polymer. Shock absorbing member 125 may comprise a nitrile rubber. Utilizing a shock absorbing member 125 between the traveling sleeve 128 and seal sleeve 126 may reduce or prevent deformation of at least one of the traveling sleeve 128 and seal sleeve 126 that may otherwise occur due to impact therebetween.

It should be noted that any sealing elements or shock absorbing members disclosed herein that are included within expandable reamer apparatus 100 may comprise any suitable material as known in the art, such as, for instance, a polymer or elastomer. Optionally, a material comprising a sealing element may be selected for relatively high temperature (e.g., about 400° Fahrenheit or greater) use. For instance, seals may be comprised of TEFLON®, polyetheretherketone ("PEEK™") material, a polymer material, or an elastomer, or may comprise a metal to metal seal suitable for expected borehole conditions. Specifically, any sealing element or shock absorbing member disclosed herein, such as shock absorbing member 125 and sealing elements O-ring seals 134 and 135, discussed hereinabove, or sealing elements, such as O-ring seal 136 discussed herein below, or other sealing elements included by an expandable reamer apparatus may comprise a material configured for relatively high temperature use, as well as for use in highly corrosive borehole environments.

The seal sleeve 126 includes an O-ring seal 136 sealing it between the inner bore 151 of the tubular body 108, and a T-seal seal 137 sealing it between the outer bore 162 of the traveling sleeve 128, which completes fluid sealing between the traveling sleeve 128 and the nozzle intake port 164. Furthermore, the seal sleeve 126 axially aligns, guides and supports the traveling sleeve 128 within the tubular body 108. Moreover, the seal sleeve seals 136 and 137 may also prevent hydraulic fluid from leaking from within the expandable reamer apparatus 100 to outside the expandable reamer apparatus 100 by way of the nozzle intake port 164 prior to the traveling sleeve 128 being released from its initial position.

A downhole end 165 of the traveling sleeve 128 (also see FIG. 5), which includes a seat stop sleeve 130, is aligned, axially guided and supported by an annular piston or lowlock sleeve 117. The lowlock sleeve 117 is axially coupled to a push sleeve 115 that is cylindrically retained between the traveling sleeve 128 and the inner bore 151 of the tubular body 108. When the traveling sleeve 128 is in the "ready" or initial position during drilling, the hydraulic pressure may act on the push sleeve 115 concentric to the tool axis and upon the lowlock sleeve 117 between the outer bore 162 of the traveling sleeve 128 and the inner bore 151 of the tubular body 108. With or without hydraulic pressure when the expandable reamer apparatus 100 is in the initial position, the push sleeve 115 is prevented from moving in the uphole direction 159 by a lowlock assembly, i.e., one or more dogs 166 of the lowlock sleeve 117.

The dogs 166 are positionally retained between an annular groove 167 in the inner bore 151 of the tubular body 108 and the seat stop sleeve 130. Each dog 166 of the lowlock sleeve 117 is a collet or locking dog latch having an expandable detent 168 that may engage the groove 167 of the tubular body 108 when compressively engaged by the seat stop sleeve 130. The dogs 166 hold the lowlock sleeve 117 in place and prevent the push sleeve 115 from moving in the uphole direction 159 until the "end" or seat stop sleeve 130, with its larger outer diameter 169, travels beyond the lowlock sleeve 117 allowing the dogs 166 to retract axially inward toward the smaller outer diameter 170 of the traveling sleeve 128. When the dogs 166 retract axially inward they may be disengaged from the groove 167 in the inner bore 151 of the tubular body 108, allowing the push sleeve 115 to be subjected to hydraulic pressure primarily in the axial direction, i.e., in the uphole direction 159.

The shear assembly 150 requires an affirmative act, such as introducing a ball or other restriction element into the expandable reamer apparatus 100 to cause the pressure from hydraulic fluid flow to increase, before the shear screws 127 will shear.

The downhole end 165 of the traveling sleeve 128 includes within its inner bore a ball trap sleeve 129 that includes a plug 131. An O-ring seal 139 may also provide a seal between the ball trap sleeve 129 and the plug 131. A restriction element in the form of a ball 147 (FIG. 18) may be introduced into the expandable reamer apparatus 100 in order to enable operation of the expandable reamer apparatus 100 to initiate or "trigger" the action of the shear assembly 150. After the ball 147 is introduced, fluid will carry the ball 147 into the ball trap sleeve 129 allowing the ball 147 to be retained and sealed by the seat part of the plug 131 and the ball trap sleeve 129. When the ball 147 occludes fluid flow by being trapped in the ball trap sleeve 129, the fluid or hydraulic pressure will build up within the expandable reamer apparatus 100 until the shear screws 127 shear. After the shear screws 127 shear, the traveling sleeve 128 along with the coaxially retained seat stop sleeve 130 will axially travel, under the influence of the hydraulic pressure, in the downhole direction 157 until the traveling sleeve 128 is again axially retained by the uplock sleeve 124 as described above or moves into a lower position. Thereafter, the fluid flow may be re-established through the fluid ports 173 in the traveling sleeve 128 above the ball 147.

Optionally, the ball 147 used to activate the expandable reamer apparatus 100 may engage the ball trap sleeve 129 and the plug 131 that include malleable characteristics, such that the ball 147 may swage therein as it seats in order to prevent the ball 147 from moving around and potentially causing problems or damage to the expandable reamer apparatus 100.

Figure 5:
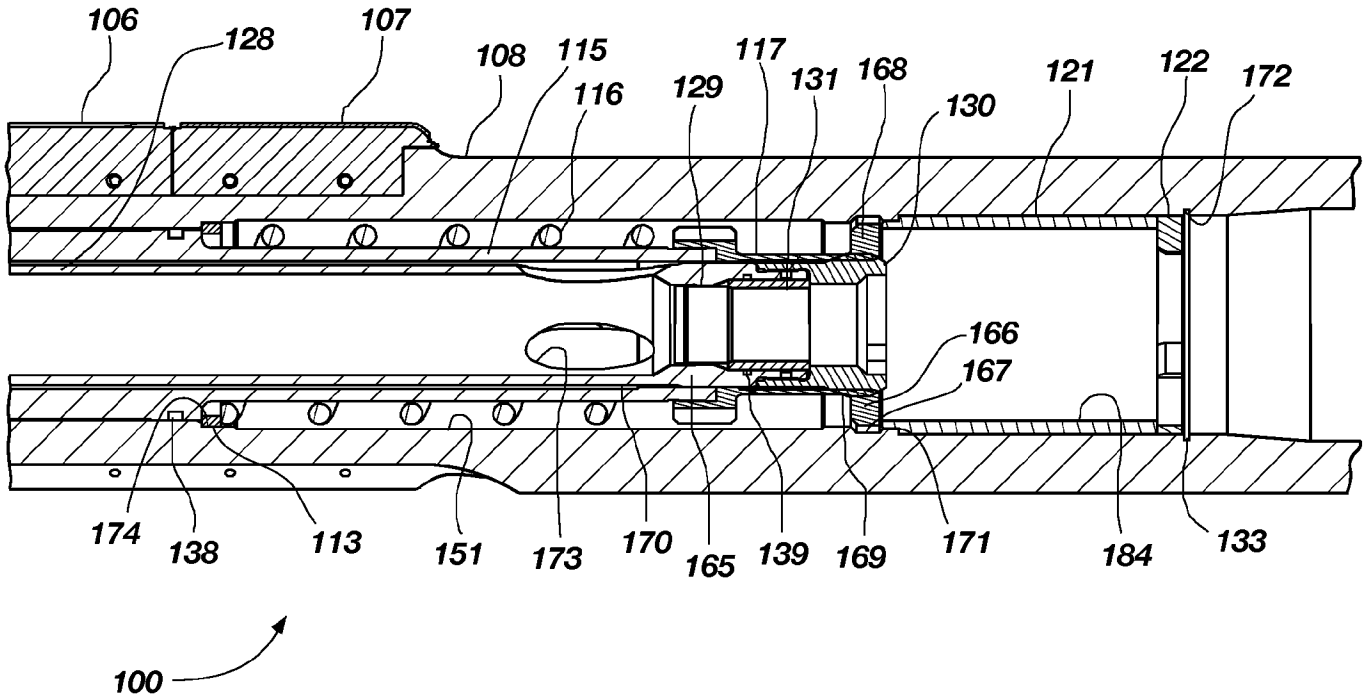
FIG. 5 shows an enlarged cross-sectional view of another portion of the expandable reamer apparatus shown in FIG. 3.
Figure 22:
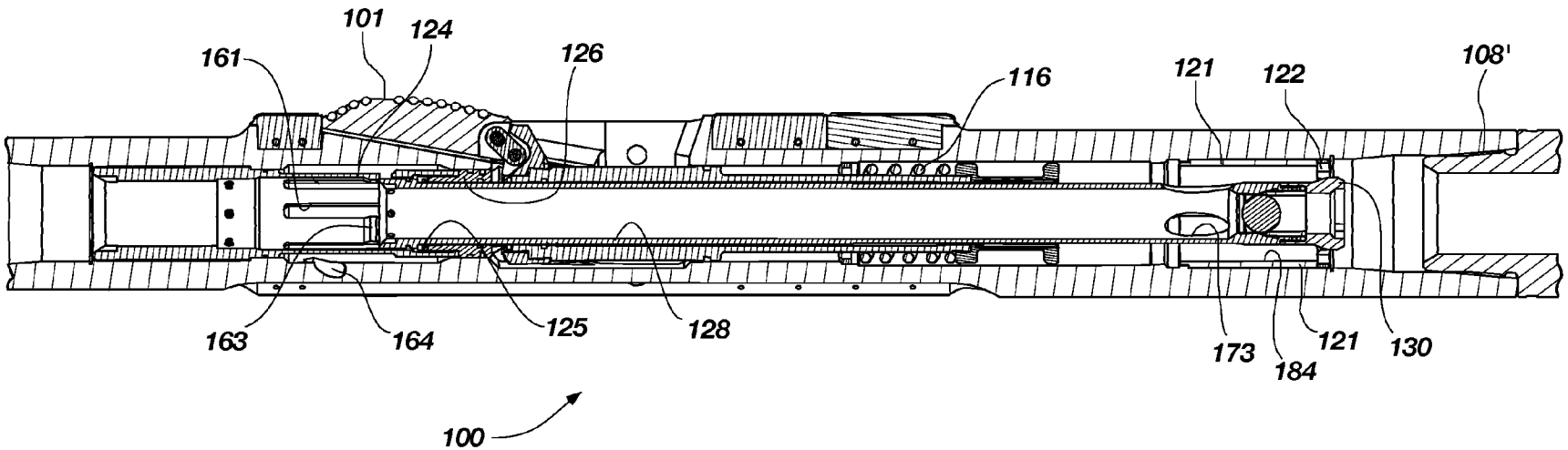
FIG. 22 shows a partial, longitudinal cross-sectional illustration of the expandable reamer apparatus of FIG. 17 in which the blades (one depicted) are held in the fully extended position by the push sleeve under the influence of fluid pressure and the traveling sleeve moves into the retained position.

Also, in order to support the traveling sleeve 128 and mitigate vibration effects after the traveling sleeve 128 is axially retained, the seat stop sleeve 130 and the downhole end 165 of the traveling sleeve 128 are retained in a stabilizer sleeve 122. Reference may also be made to FIGS. 5 and 22. The stabilizer sleeve 122 is coupled to the inner bore 151 of the tubular body 108 and retained between a retaining ring 133 and a protect sleeve 121, which is held by an annular lip 171 in the inner bore 151 of the tubular body 108. The retaining ring 133 is held within an annular groove 172 in the inner bore 151 of the tubular body 108. The protect sleeve 121 provides protection from the erosive nature of the hydraulic fluid to the tubular body 108 by allowing hydraulic fluid to flow through fluid ports 173 of the traveling sleeve 128, impinge upon the protect sleeve 121 and past the stabilizer sleeve 122 when the traveling sleeve 128 is retained therein.

Figure 21:
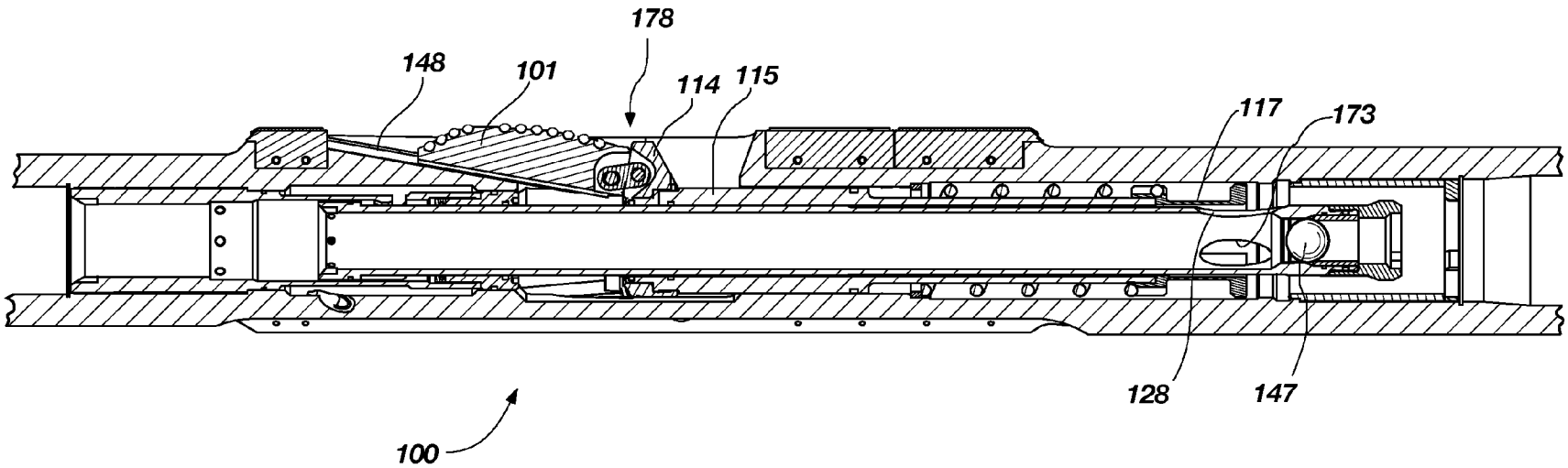
FIG. 21 shows a partial, longitudinal cross-sectional illustration of the expandable reamer apparatus of FIG. 17 in which the traveling sleeve moves toward a lower, retained position while a blade being urged by a push sleeve under the influence of fluid pressure moves toward an extended position.

After the traveling sleeve 128 travels sufficiently far enough to allow the dogs 166 of the lowlock sleeve 117 to be disengaged from the groove 167 in the inner bore 151 of the tubular body 108, the dogs 166 of the lowlock sleeve 117 being connected to the push sleeve 115 may all move in the uphole direction 159. Reference may also be made to FIGS. 5, 6 and 21. In order for the push sleeve 115 to move in the uphole direction 159, the differential pressure between the inner bore 151 and the outer side 183 of the tubular body 108 caused by the hydraulic fluid flow must be sufficient to overcome the restoring force or bias of a spring 116. The compression spring 116 that resists the motion of the push sleeve 115 in the uphole direction 159, is retained on the outer surface 175 of the push sleeve 115 between a ring 113 attached in a groove 174 of the tubular body 108 and the lowlock sleeve 117. The push sleeve 115 may axially travel in the uphole direction 159 under the influence of the hydraulic fluid, but is restrained from moving beyond the top lip of the ring 113 and beyond the protect sleeve 121 in the downhole direction 157. The push sleeve 115 may include a T-seal seal 138 between the tubular body 108, a T-seal seal 137 between the traveling sleeve 128, and a wiper seal 141 between the traveling sleeve 128 and push sleeve 115.

Figure 16:
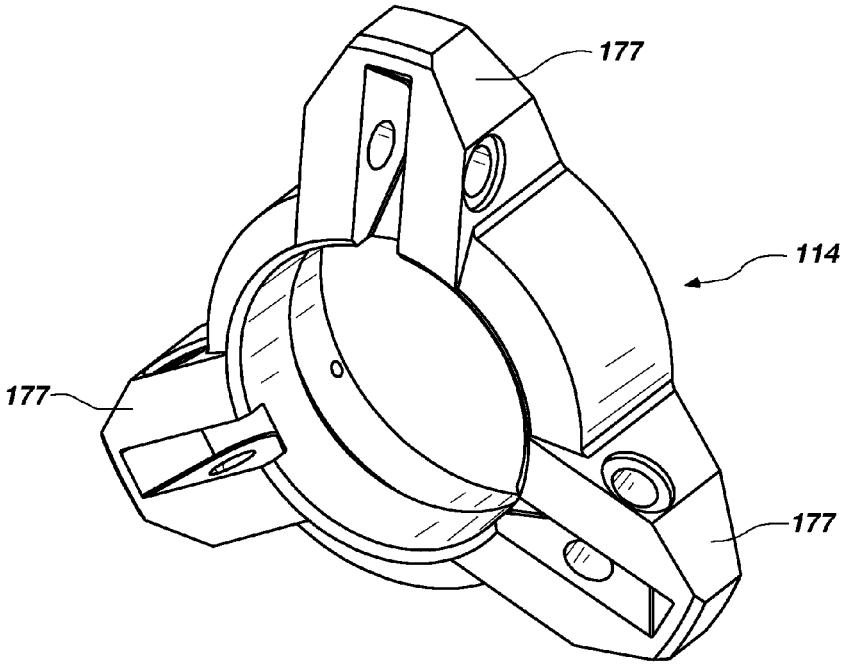
FIG. 16 shows a perspective view of a yoke of an embodiment of the expandable reamer apparatus.

The push sleeve 115 includes at its uphole section 176 a yoke 114 coupled thereto as shown in FIG. 6. The yoke 114 (also shown in FIG. 16) includes three arms 177, each arm 177 being coupled to one of the blades 101, 102, 103 by a pinned linkage 178. The arms 177 may include a shaped surface suitable for expelling debris as the blades 101, 102, 103 are retracted toward the retracted position. The shaped surface of the arms 177, in conjunction with the adjacent wall of the cavity of the tubular body 108, may provide included angles of approximately 20 degrees, which is preferable to dislodge and remove any packed-in shale, and may further include low friction surface material to prevent sticking by formation cuttings and other debris. The pinned linkage 178 includes a linkage 118 coupling a blade to the arm 177, where the linkage 118 is coupled to the blade by a blade pin 119 and secured by a retaining ring 142, and the linkage 118 is coupled to the arm 177 by a yoke pin 120 which is secured by a cotter pin 144. The pinned linkage 178 allows the blades 101, 102, 103 to rotationally transition about the arms 177 of the yoke 114, particularly as the actuating means directly transitions the blades 101, 102, 103 between the extended and retracted positions. Advantageously, the actuating mean, i.e., the push sleeve 115, the yoke 114, and or the pinned linkage 178, directly retracts as well as extends the blades 101, 102, 103, whereas conventional wisdom has directed the use of one part for harnessing hydraulic pressure to force the blade laterally outward and another part, such as a spring, to force the blades inward.

In order that the blades 101, 102, 103 may transition between the extended and retracted positions, they are each positionally coupled to one of the blade tracks 148 in the tubular body 108 as particularly shown in FIGS. 3 and 6. The blade 101 is also shown in FIGS. 10-14. The blade track 148 includes a dovetailed-shaped groove 179 that axially extends along the tubular body 108 on a slanted slope 180 having an acute angle with respect to the longitudinal axis $L_8$. Each of the blades 101, 102, 103 include a dovetailed-shaped rail 181 that substantially matches the dovetailed-shaped groove 179 of the blade track 148 in order to slidably secure the blades 101, 102, 103 to the tubular body 108. When the push sleeve 115 is influenced by the hydraulic pressure, the blades 101, 102, 103 will be extended upward and outward through a blade passage port 182 into the extended position ready for cutting the formation. The blades 101, 102, 103 are pushed along the blade tracks 148 until the forward motion is stopped by the tubular body 108 or the upper stabilizer block 105 being coupled to the tubular body 108. In the upward-outward or fully extended position, the blades 101, 102, 103 are positioned such that the cutting elements 104 will enlarge a bore hole in the subterranean formation by a prescribed amount. When hydraulic pressure provided by drilling fluid flow through expandable reamer apparatus 100 is released, the spring 116 will urge the blades 101, 102, 103 via the push sleeve 115 and the pinned linkage 178 into the retracted position. Should the assembly not readily retract via spring force, when the tool is pulled up the borehole to a casing shoe, the shoe may contact the blades 101, 102, 103 helping to urge or force them down the blade tracks 148, allowing the expandable reamer apparatus 100 to be retrieved from the borehole. In this respect, the expandable reamer apparatus 100 includes retraction assurance feature to further assist in removing the expandable reamer apparatus 100 from a borehole. The slanted slope 180 of blade tracks 148 in this embodiment is ten degrees, taken with respect to the longitudinal axis $L_8$ of the expandable reamer apparatus 100. While the slanted slope 180 of the blade tracks 148 is ten degrees, it may vary from a greater extent to a lesser extent than that illustrated. However, the slanted slope 180 should be less than substantially 35 degrees, for reasons discussed below, to obtain the full benefit of this aspect of the embodiments herein. The blades 101, 102, 103, being "locked" into the blade tracks 148 with the dovetail-shaped rails 181 as they are axially driven into the extended position permits looser tolerances as compared to conventional hydraulic reamers which required close tolerances between the blade pistons and the tubular body 108 to radially drive the blade pistons into their extended position. Accordingly, the blades 101, 102, 103 are more robust and less likely to bind or fail due to blockage from the fluid. In this embodiment, the blades 101, 102, 103 have ample clearance in the dovetail-shaped grooves 179 of the blade tracks 148, such as a 1/16 inch clearance, more or less, between the dovetail-shaped rail 181 and dovetail-shaped groove 179. It is to be recognized that the term "dovetail" when making reference to the dovetail-shaped groove 179 or the dovetail-shaped rail 181 is not to be limiting, but is directed broadly toward structures in which each blade 101, 102, 103 is retained with the tubular body 108 of the expandable reamer apparatus 100, while further allowing the blades 101, 102, 103 to transition between two or more positions along the blade tracks 148 (see also FIG. 2) without binding or mechanical locking.

Reactive forces acting on the cutting elements 104 on the blades 101, 102, 103 during rotation of expandable reamer apparatus 100 in engaging a formation while reaming a borehole may help to further push the blades 101, 102, 103 in the extended outward direction, holding them with this force in their fully outward or extended position. Drilling forces acting on the cutting elements 104, therefore, along with higher pressure within expandable reamer apparatus 100 creating a pressure differential with that of the borehole exterior to the expandable reamer apparatus 100, help to further hold the blades 101, 102, 103 in the extended or outward position. Also, as the expandable reamer apparatus 100 is drilling, the fluid pressure may be reduced when the combination of the slanted slope 180 of the blade tracks 148 is sufficiently shallow allowing the reactive forces acting on the cutting elements 104 to offset the biasing effect of the biasing spring 116. In this regard, application of hydraulic fluid pressure may be substantially minimized while drilling as a mechanical advantage allows the reactive forces acting on the cutting elements 104 when coupled with the substantially shallower slanted slope 180 of the tracks 148 to provide the requisite reaction force for retaining the blades 101, 102, 103 in their extended position. Conventional reamers having blades extending substantially laterally outward from an extent of 35 degrees or greater (referenced to the longitudinal axis) require the full, and continued, application of hydraulic pressure to maintain the blades in an extended position. Accordingly and unlike the case with conventional expandable reamer apparatuses, the blades 101, 102, 103 of expandable reamer apparatus 100 have a tendency to open as opposed to tending to close when reaming a borehole. The direction of the net cutting force and, thus, of the reactive force may be adjusted by altering the backrake, exposure and siderake of the cutting elements 104 to better achieve a net force tending to move the blades 101, 102, 103 to their fullest outward extent.

Another advantage of a so-called "shallow track," i.e., the substantially small slanted slope 180 having an acute angle, is greater spring force retraction efficiency. Improved retraction efficiency enables improved or customized spring rates to be utilized to control the extent of the biasing force by the spring 116, such as selecting the biasing force required to be overcome by hydraulic pressure to begin to move or fully extend the blades 101, 102, 103. Also, with improved retraction efficiency greater assurance of blade retraction is assured when the hydraulic fluid pressure is removed the expandable reamer apparatus 100. Optionally, the spring 116 may be preloaded when the expandable reamer apparatus 100 is in the initial or retracted positions, allowing a minimal amount of retraction force to be constantly applied.

Another advantage provided by the blade tracks 148 is the unitary design of each "dovetail-shaped" groove 179, there being one groove 179 for receiving one of the oppositely opposed "dovetailed shaped" rails 181 of the guides 187 (FIG. 10) on each side of the blades 101, 102, 103. In conventional expandable reamer apparatuses, each side of a movable blade includes a plurality of ribs or channels for being received into opposing ribs or channels, respectively, of the reamer body, such arrangements being highly prone to binding when the blades are subjected to operational forces and pressures. In addition to ease of blade extension and retraction without binding along or in the track 148, the single rail and cooperating groove design provides non-binding structural support for blade operation, particularly when engaging a formation while reaming.

Figure 1B:
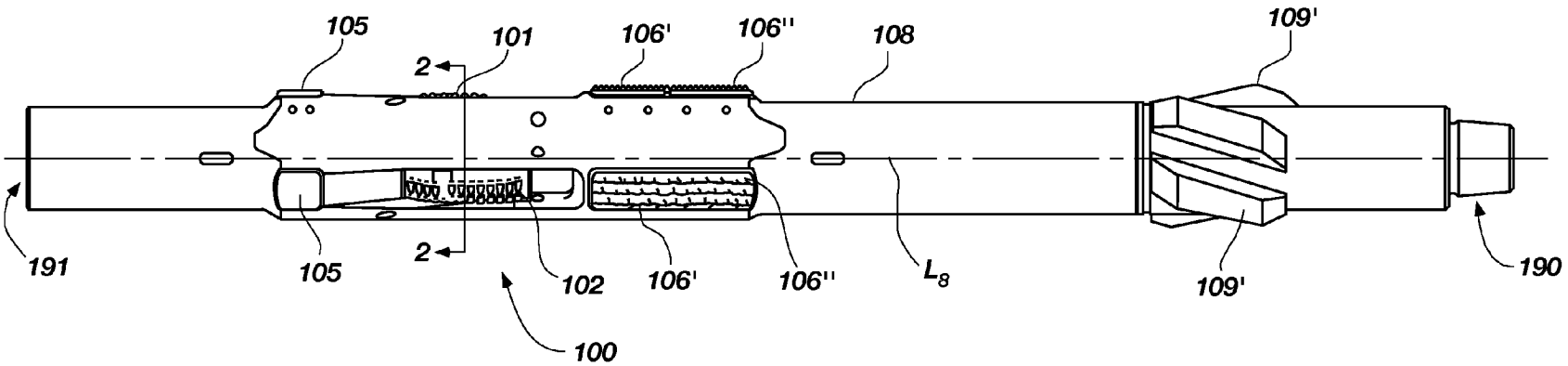
FIG. 1B is a side view of another embodiment of an expandable reamer apparatus and stabilizer.
Figure 1C:
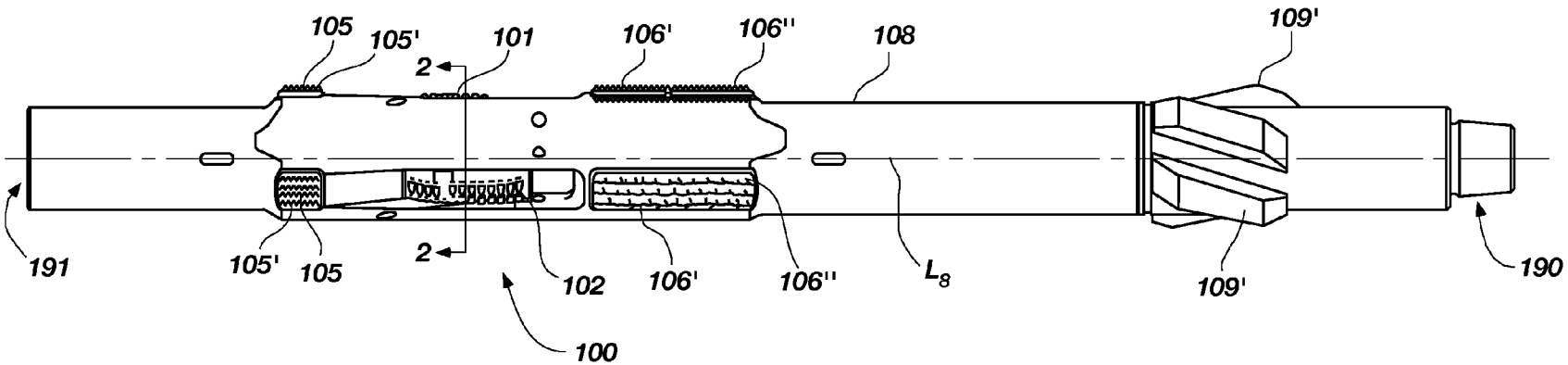
FIG. 1C is a side view of another embodiment of an expandable reamer apparatus and stabilizer.

In addition to the upper stabilizer block 105, the expandable reamer apparatus 100 also includes a mid stabilizer block 106 and a lower stabilizer block 107 (as shown in FIGS. 1 and 1A). Optionally, the mid stabilizer block 106 and the lower stabilizer block 107 may be combined into a unitary stabilizer block having suitable hardfacing 106" thereon as shown in FIG. 1B. A further option of the stabilizer block 105 and 106' is illustrated in FIG. 1C where such blocks 105 and 106' are formed integrally with the tubular housing 108 having a hardfacing 105' and 106" thereon. The stabilizer blocks 105, 106, 107 help to center the expandable reamer apparatus 100 in the drill hole while being run into position through a casing or liner string and also while drilling and reaming the borehole. As mentioned above, the upper stabilizer block 105 may be used to stop or limit the forward motion of the blades 101, 102, 103, determining the extent to which the blades 101, 102, 103 may engage a borehole while drilling. The upper stabilizer block 105, in addition to providing a back stop for limiting the lateral extent of the blades 101, 102, 103, may provide for additional stability when the blades 101, 102, 103 are retracted and the expandable reamer apparatus 100 of a drill string is positioned within a borehole in an area where an expanded hole is not desired while the drill string is rotating.

Advantageously, the upper stabilizer block 105 may be mounted, removed and/or replaced by a technician, particularly in the field, allowing the extent to which the blades 101, 102, 103 engage the borehole to be readily increased or decreased to a different extent than illustrated. Optionally, it is recognized that a stop associated on a track side of the upper stabilizer block 105 may be customized in order to arrest the extent to which the blades 101, 102, 103 may laterally extend when fully positioned to the extended position along the blade tracks 148. The stabilizer blocks 105, 106, 107 may include hardfaced bearing pads (not shown) to provide a surface for contacting a wall of a borehole while stabilizing the apparatus expandable reamer apparatus 100 therein during a drilling operation.

Figure 9:
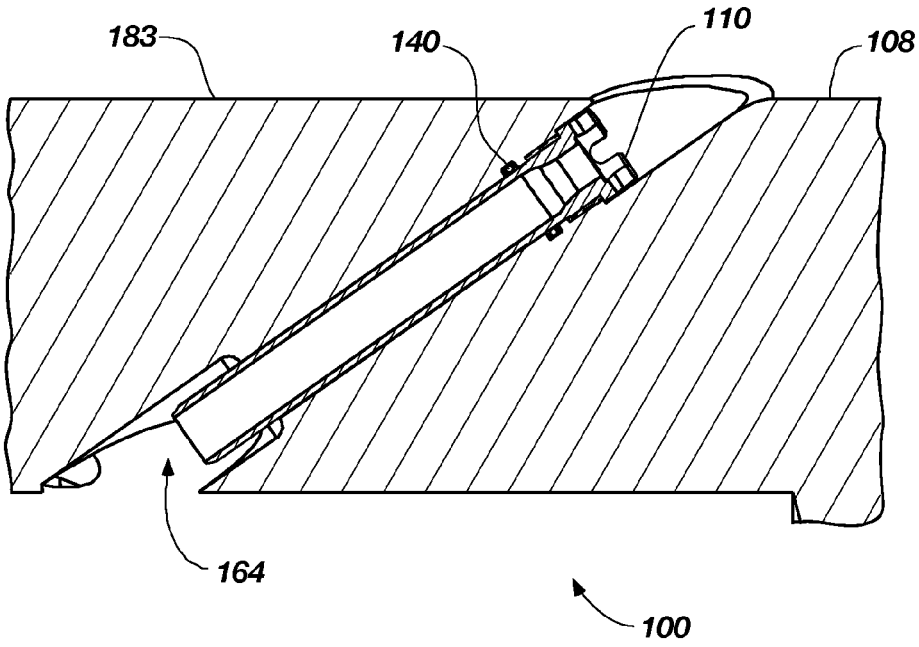
FIG. 9 shows a cross-sectional view of a nozzle assembly of an embodiment of the expandable reamer apparatus.
Figure 10:
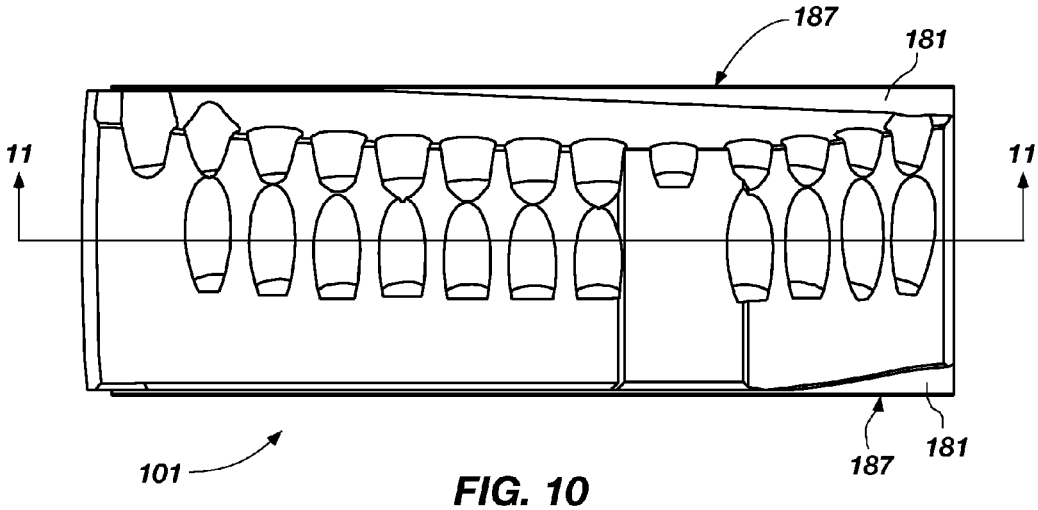
FIG. 10 shows a top view of a blade in accordance with an embodiment.
Figure 11:
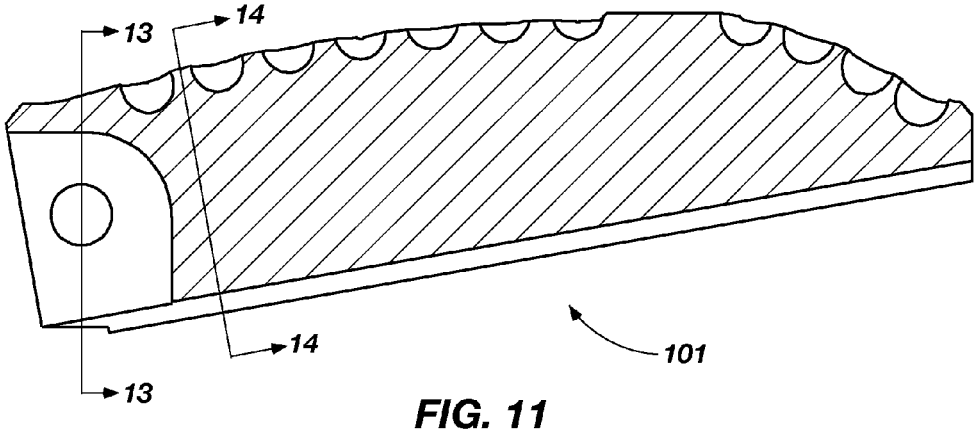
FIG. 11 shows a longitudinal cross-sectional view of the blade taken along section line 11-11 in FIG. 10.
Figure 12:
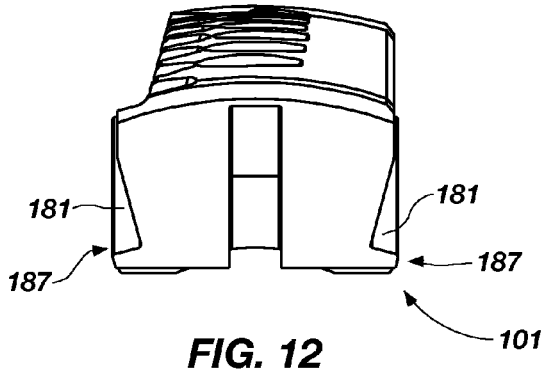
FIG. 12 shows a longitudinal end view of the blade of FIG. 10.
Figure 13:
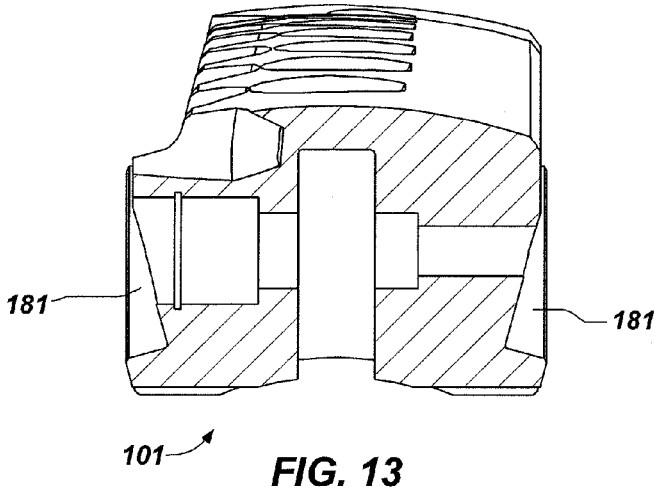
FIG. 13 shows a cross-sectional view taken along section line 13-13 in FIG. 11.
Figure 14:
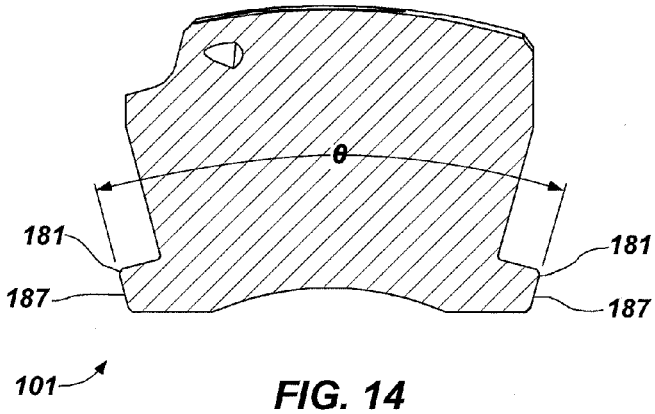
FIG. 14 shows a cross-sectional view taken along section line 14-14 in FIG. 11.

Also, the expandable reamer apparatus 100 may include tungsten carbide nozzles 110 as shown in FIG. 9. The nozzles 110 are provided to cool and clean the cutting elements 104 and clear debris from blades 101, 102, 103 during drilling. The nozzles 110 may include an O-ring seal 140 between each nozzle 110 and the tubular body 108 to provide a seal between the two components. As shown, the nozzles 110 are configured to direct drilling fluid towards the blades 101, 102, 103 in the downhole direction 157, but may be configured to direct fluid laterally or in the uphole direction 159.

Figure 18:
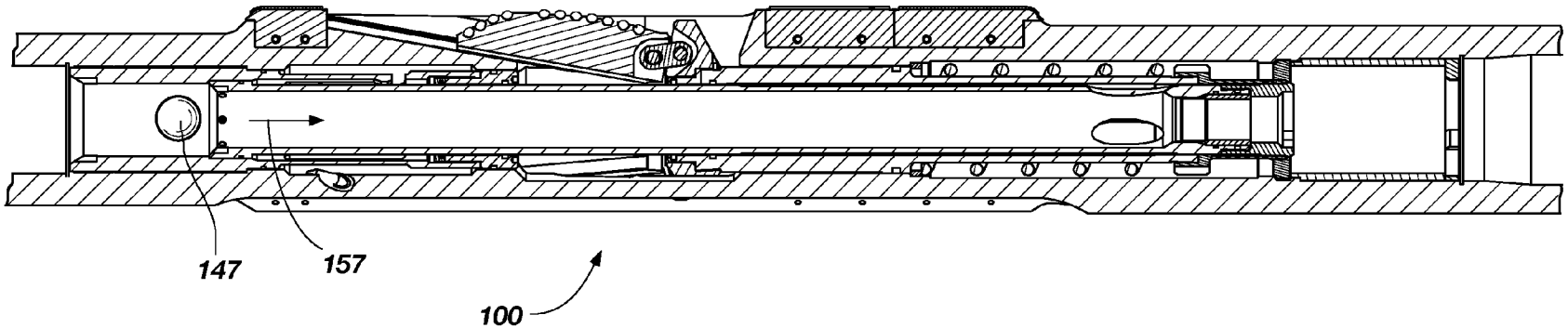
FIG. 18 shows a partial, longitudinal cross-sectional illustration of the expandable reamer apparatus of FIG. 17 in the initial tool position, receiving a ball in a fluid path.
Figure 19:
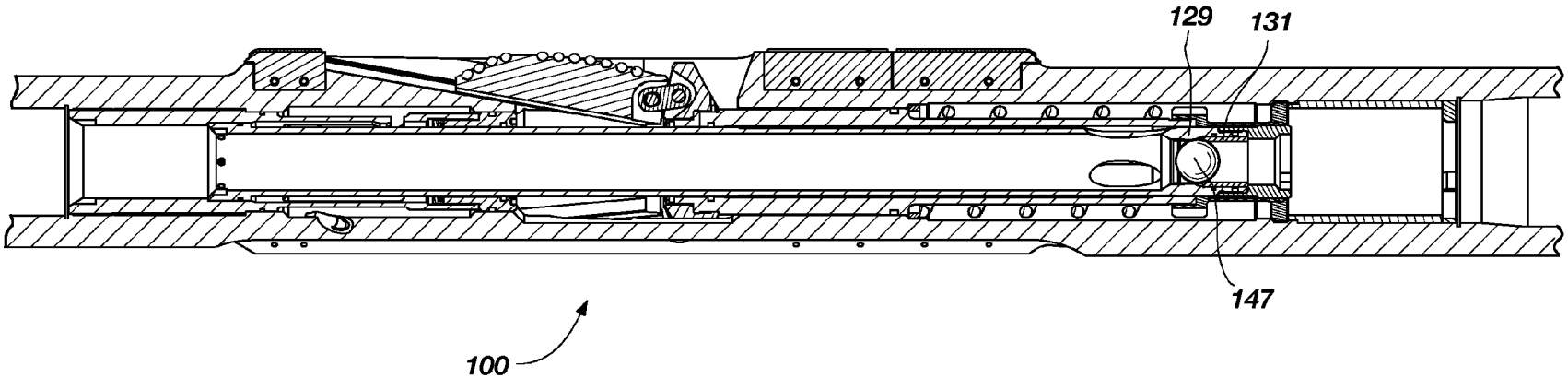
FIG. 19 shows a partial, longitudinal cross-sectional illustration of the expandable reamer apparatus of FIG. 17 in the initial position tool in which the ball moves into a ball seat and is captured.

The expandable reaming apparatus, or reamer, 100 is now described in terms of its operational aspects. Reference may be made to FIGS. 17-23, in particular, and optionally to FIGS. 1-16, as desirable. The expandable reamer apparatus 100 may be installed in a bottomhole assembly above a pilot bit and, if included, above or below the measurement while drilling (MWD) device and incorporated into a rotary steerable system (RSS) and rotary closed loop system (RCLS), for example. Before "triggering" the expandable reamer apparatus 100, the expandable reamer apparatus 100 is maintained in an initial, retracted position as shown in FIG. 17. For instance, the traveling sleeve 128 within the expandable reamer apparatus 100 isolates the fluid flow path and prevents inadvertent extension of blades 101, 102, 103, as previously described, and is retained by the shear assembly 150 with shear screws 127 secured to the uplock sleeve 124 which is attached to the tubular body 108. While the traveling sleeve 128 is held in the initial position, the blade actuating means is prevented from directly actuating the blades 101, 102, 103 whether acted upon by biasing forces or hydraulic forces. The traveling sleeve 128 has, on its lower end, an enlarged end piece, the seat stop sleeve 130. This seat stop sleeve 130, with its larger outer diameter 169, holds the dogs 166 of the lowlock sleeve 117 in a secured position, preventing the push sleeve 115 from moving upward under effects of differential pressure and activating the blades 101, 102, 103. The dogs 166 lock the latch or expandable detent 168 into a groove 167 in the inner bore 151 of the tubular body 108. When it is desired to trigger the expandable reamer apparatus 100, drilling fluid flow is momentarily ceased, if required, and a ball 147, or other fluid restricting element, is dropped into the drill string and pumping of drilling fluid resumed. The ball 147 moves in the downhole direction 157 under the influence of gravity and/or the flow of the drilling fluid, as shown in FIG. 18. After a short time the ball 147 reaches a ball seat of the ball trap sleeve 129, as shown in FIG. 19. The ball 147 stops drilling fluid flow and causes pressure to build above it in the drill string. As the pressure builds, the ball 147 may be further seated into or against the plug 131, which may be made of, or lined with, a resilient material such as tetrafluoroethylene (TFE).

Figure 20:
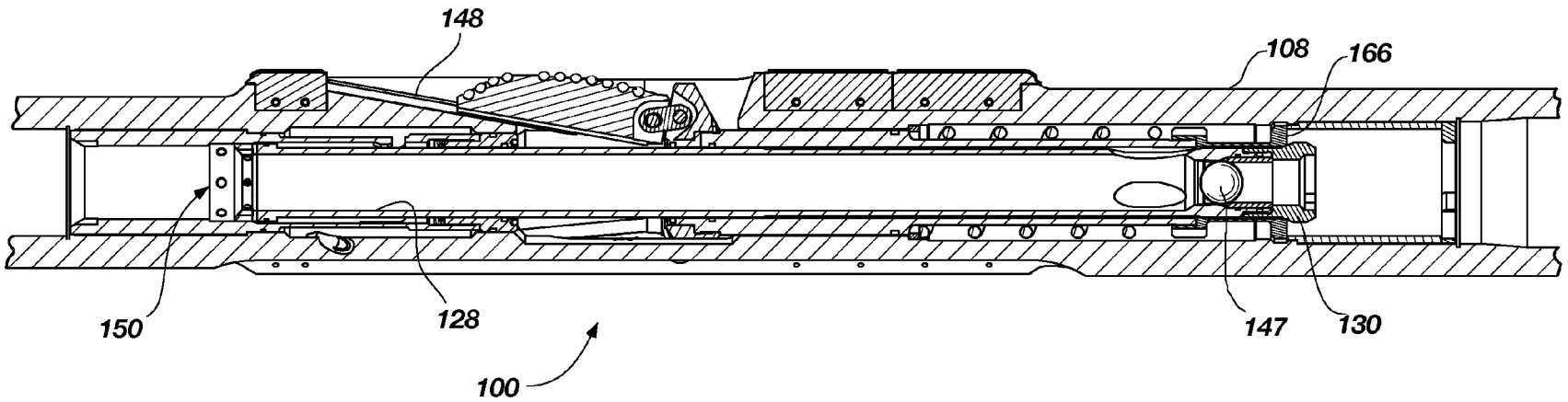
FIG. 20 shows a partial, longitudinal cross-sectional illustration of the expandable reamer apparatus of FIG. 17 in which a shear assembly is triggered as pressure is accumulated and a traveling sleeve begins to move down within the apparatus, leaving the initial tool position.

Referring to FIG. 20, at a predetermined pressure level, set by the number and individual shear strengths of the shear screws 127 (made of brass or other suitable material) installed initially in the expandable reamer apparatus 100, the shear screws 127 will fail in the shear assembly 150 and allow the traveling sleeve 128 to unseal and move downward. As the traveling sleeve 128 with the larger end of the seat stop sleeve 130 moves downward, the latch dogs 166 of the lowlock sleeve 117 are free to move inward toward the smaller diameter of the traveling sleeve 128 and become free of the tubular body 108.

Thereafter, as illustrated in FIG. 21, the lowlock sleeve 117 is attached to the pressure-activated push sleeve 115 which now moves upward under fluid pressure influence as fluid is allowed to pass through the fluid ports 173 exposed as the traveling sleeve 128 moves downward. As the fluid pressure is increased the biasing force of the spring 116 is overcome allowing the push sleeve 115 to move in the uphole direction 159. The push sleeve 115 is attached to the yoke 114 which is attached by pins and linkage assembly 178 to the three blades 101, 102, 103, which are now moved upwardly by the push sleeve 115. In moving upward, the blades 101, 102, 103 each follow a ramp or blade track 148 to which they are mounted, via a type of modified square dovetail-shaped groove 179 (shown in FIG. 2), for example.

FIG. 22, the stroke of the blades 101, 102, 103 is stopped in the fully extended position by upper hardfaced pads on the upper stabilizer block 105, for example. Optionally, as mentioned herein above, a customized stabilizer block may be assembled to the expandable reamer apparatus 100 prior to drilling in order to adjust and limit the extent to which the blades 101, 102, 103 may extend. With the blades 101, 102, 103 in the extended position, reaming a borehole may commence.

As reaming takes place with the expandable reamer apparatus 100, the hardfaced lower and mid stabilizer blocks 106, 107 help to stabilize the tubular body 108 as the cutting elements 104 of the blades 101, 102, 103 ream a larger borehole and the hardfaced upper stabilizer block 105 also helps to stabilize the top of the expandable reamer apparatus 100 when the blades 101, 102 and 103 are in the retracted position.

After the traveling sleeve 128 with the ball 147 move downward, the ball 147 comes to a stop with the flow bypass or fluid ports 173 located above the ball 147 in the traveling sleeve 128 exiting against the inside wall 184 of the hardfaced protect sleeve 121, which helps to prevent or minimize erosion damage from drilling fluid flow impinging thereupon. The drilling fluid flow may then continue down the bottom hole assembly, and the upper end of the traveling sleeve 128 becomes "trapped," i.e., locked, between the one or more ears 163 of the uplock sleeve 124 and the shock absorbing member 125 of the seal sleeve 126 and the lower end of the traveling sleeve 128 is laterally stabilized by the stabilizer sleeve 122.

Figure 23:
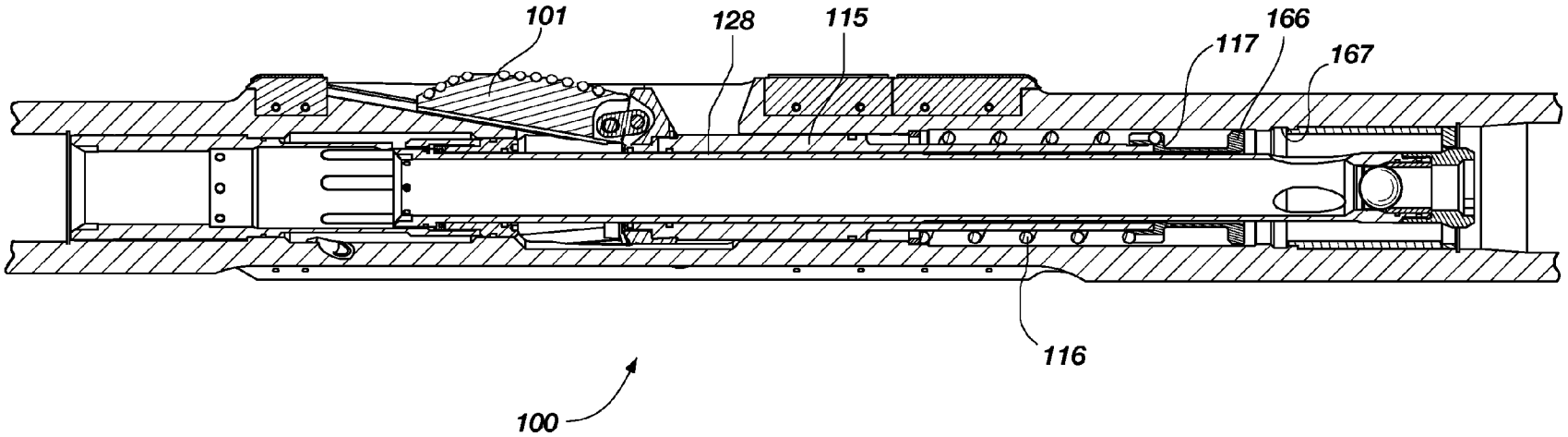
FIG. 23 shows a partial, longitudinal cross-sectional illustration of the expandable reamer apparatus of FIG. 17 in which the blades (one depicted) are retracted into a retracted position by a biasing spring when the fluid pressure is dissipated.

When drilling fluid pressure is released, the spring 116 will help drive the lowlock sleeve 117 and the push sleeve 115 with the attached blades 101, 102, 103 back downwardly and inwardly substantially to their original or initial position into the retracted position, see FIG. 23. However, since the traveling sleeve 128 has moved to a downward locked position, the seat stop sleeve 130, with its larger outer diameter 169 will no longer hold the dogs 166 out and in the groove 167 and thus the latch or lowlock sleeve 117 stays unlatched and subjected to pressure differentials for subsequent operation or activation.

Whenever drilling fluid flow is re-established in the drill pipe and through the expandable reamer apparatus 100, the push sleeve 115 with the yoke 114 and blades 101, 102, 103 may move upward with the blades 101, 102, 103 following the ramp or track 148 to again cut/ream the prescribed larger diameter in a borehole. Whenever drilling fluid flow is stopped, i.e., the differential pressure falls below the restoring force or bias of the spring 116, the blades 101, 102, 103 retract, as described above, via the spring 116.

The expandable reamer apparatus 100 overcomes disadvantages of conventional reamers. For example, one conventional hydraulic reamer utilized pressure from inside the tool to apply force against cutter pistons which moved radially outward. It is felt by some that the nature of the conventional reamer allows misaligned forces to cock and jam the pistons, preventing the springs from retracting them. By providing the expandable reamer apparatus 100 that slides each of the blades up a relatively shallow-angled ramp, higher drilling forces may be used to open and extend the blades to their maximum position while transferring the forces through to the upper hardfaced pad stop with no damage thereto and subsequently allowing the spring to retract the blades thereafter without jamming or cocking.

The expandable reamer apparatus 100 includes blades that, if not retracted by the spring, will be pushed down the ramp of the blade track by contact with the borehole wall and the casing and allow the expandable reamer apparatus 100 to be pulled through the casing, providing a kind of fail-safe function.

The expandable reamer apparatus 100 is not sealed around the blades 101, 102, 103 and does not require seals thereon, such as the expensive or custom made seals used in some conventional expandable reamer apparatuses.

The expandable reamer apparatus 100 includes clearances of ranging from 0.010 of an inch to 0.030 of an inch between adjacent parts having dynamic seals therebetween. The dynamic seals are all conventional, circular seals. Moreover, the sliding mechanism or actuating means, which includes the blades in the blade tracks, includes clearances ranging from 0.050 of an inch to 0.100 of an inch, particularly about the dovetail-shaped portions. Clearances in the expandable reamer apparatus, the blades and the blade tracks may vary to a somewhat greater extent or a lesser extent than indicated herein. The larger clearances and tolerances of the parts of expandable reamer apparatus 100 promote ease of operation, particularly with a reduced likelihood of binding caused by particulates in the drilling fluid and formation debris cut from the borehole wall.

Additional aspects of the expandable reamer apparatus 100 are now provided:

The blade 101 may be held in place along the blade track 148 (shown in FIG. 2) by guides 187. The blade 101 includes mating guides 187 as shown in FIGS. 10-14. Each mating guide 187 is comprised of a single dovetail-shaped rail 181 oppositely located on each side of the blade 101 and includes an included angle θ that is selected to prevent binding with the mating guides 187 of the blade track 148. The included angle θ of the dovetail-shaped rails 181 of the blade 101 in this embodiment is 30 degrees such that the blade 101 is prone to move away from or provide clearance about the blade track 148 in the tubular body 108 when subjected to the hydraulic pressure.

The blades 101, 102, 103 are attached to a yoke 114 with the linkage assembly, as described herein, which allow the blades 101, 102, 103 to move upward and radially outward along the 10 degree ramp, in this embodiment, as the actuating means, i.e., the yoke 114 and push sleeve 115, moves axially upward. The link of the linkage assembly is pinned to both the blades 101, 102, 103 and the yoke 114 in a similar fashion. The linkage assembly, in addition to allowing the actuating means to directly extend and retract the blades 101, 102, 103 substantially in the longitudinal or axial direction, enables the upward and radially outward extension of the blades 101, 102, 103 by rotating through an angle, approximately 48 degrees in this embodiment, during the direct actuation of the actuating means and the blades 101, 102, 103.

In case the blades 101, 102, 103 somehow do not readily move back down the ramp of the blade tracks 148 under biasing force from the retraction spring 116, then as the expandable reamer apparatus 100 is pulled from the borehole, contact with the bore hole wall will bump the blades 101, 102, 103 down the slanted slope 180 of the blade tracks 148. If needed, the blades 101, 102, 103 of the expandable reamer apparatus 100 may be pulled up against the casing which may push the blades 101, 102, 103 further back into the retracted position thereby allowing access and removal of the expandable reamer apparatus 100 through the casing.

In other embodiments herein, the traveling sleeve 128 may be sealed to prevent fluid flow from exiting the expandable reamer apparatus 100 through the blade passage ports 182, and after triggering, the seal may be maintained.

The nozzles 110, as mentioned above, may be directed in the direction of flow through the expandable reamer apparatus 100 from within the tubular body 108 downward and outward radially to the annulus between tubular body 108 and a borehole. Directing the nozzles 110 in such a downward direction causes counterflow as the flow exits the nozzle 110 and mixes with the annular moving counter flow returning up the borehole and may improve blade cleaning and cuttings removal. The nozzles 110 are directed at the cutters of the blades 101, 102, 103 for maximum cleaning, and may be directionally optimized using computational fluid dynamics ("CFD") analysis.

Still other aspects of the expandable reamer apparatus 100 are now provided:

The shear screws 127 of the shear assembly 150, retaining the traveling sleeve 128 and the uplock sleeve 124 in the initial position, are used to provide or create a trigger, releasing when pressure builds to a predetermined value. The predetermined value at which the shear screws 127 shear under drilling fluid pressure within expandable reamer apparatus 100 may be 1000 psi, for example, or even 2000 psi. It is recognized that the pressure may range to a greater or lesser extent than presented herein to trigger the expandable reamer apparatus 100. Optionally, it is recognized that a greater pressure at which the shear screws 127 shears may be provided to allow the spring 116 to be conditionally configured and biased to a greater extent in order to further provide desired assurance of blade retraction upon release of hydraulic fluid.

Optionally, one or more of the blades 101, 102, 103 may be replaced with stabilizer blocks having guides and rails as described herein for being received into dovetail-shaped grooves 179 of the blade tracks 148 in the expandable reamer apparatus 100, which may be used as expandable concentric stabilizer rather than a reamer, which may further be utilized in a drill string with other concentric reamers or eccentric reamers.

Optionally, the blades 101, 102, 103 may each include one row or three or more rows of cutting elements 104 rather than the two rows of cutting elements 104 shown in FIG. 2. Advantageously, two or more rows of cutting elements 104 help to extend the life of the blades 101, 102, 103 particularly when drilling in hard formations.

Figure 24:
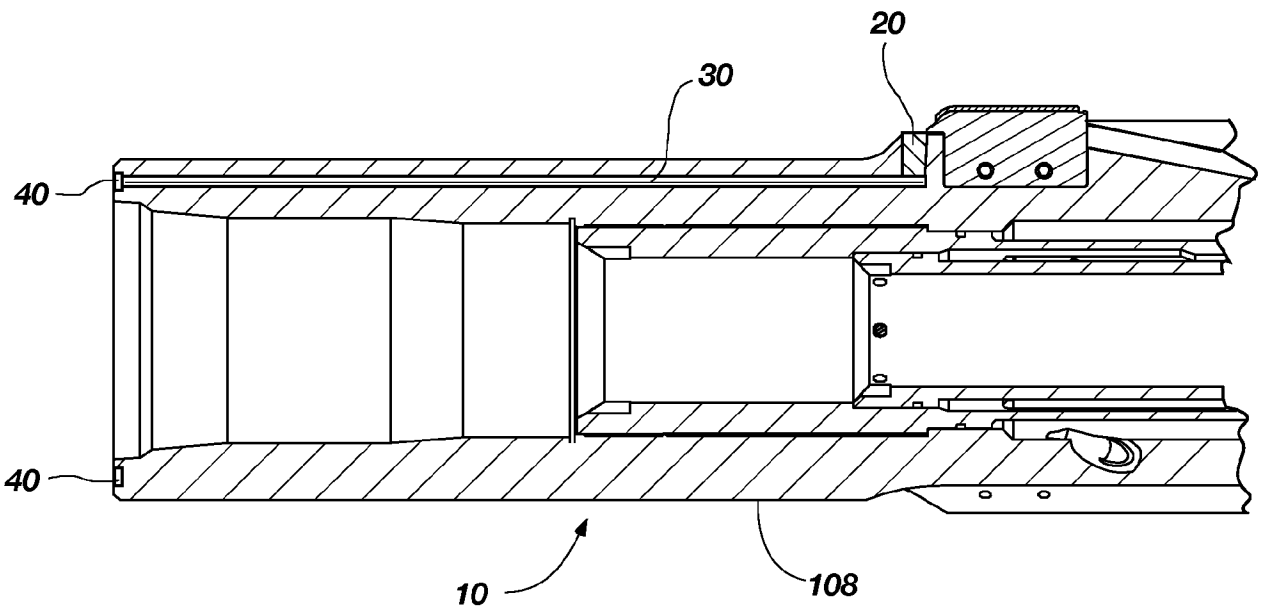
FIG. 24 shows a partial, longitudinal cross-sectional view of an expandable reamer apparatus including a borehole dimension measurement device in accordance with another embodiment herein.

FIG. 24 shows a cross-sectional view of an embodiment of an expandable reamer apparatus 10 having a measurement device 20 in accordance with another embodiment. The measurement device 20 provides an indication of the distance between the expandable reamer apparatus 10 and a wall of a borehole being drilled, enabling a determination to be made as to the extent at which the expandable reamer apparatus 10 is enlarging a borehole. As shown, the measurement device 20 is mounted to the tubular body 108 generally in a direction perpendicular to the longitudinal axis $L_8$ of the expandable reamer apparatus 10. The measurement device 20 is coupled to a communication line 30 extending through a tubular body 108 of the expandable reamer apparatus 10 that includes an end connection 40 at the upper end 191 of the expandable reamer apparatus 10. The end connection 40 may be configured for connection compatibility with particular or specialized equipment, such as a MWD communication subassembly. The communication line 30 may also be used to supply power to the measurement device 20. The measurement device 20 may be configured for sensing, analyzing and/or determining the size of a borehole, or it may be used purely for sensing in which the size of a bore hole may be analyzed or determined by other equipment as is understood by a person of skill in the MWD art, thereby providing a substantially accurate determination of a borehole size. The measurement device 20 becomes instrumental in determining when the expandable reamer apparatus 10 is not drilling at its intended diameter, allowing remedial measures to be taken rather than drilling for extended durations or thousands of feet to enlarge a borehole which would then have to be re-reamed.

The measurement device 20 may be part of a nuclear based measurement system such as disclosed in U.S. Pat. No. 5,175,429 to Hall et al., the disclosure of which is fully incorporated herein by reference, and is assigned to the assignee of the application herein disclosed. The measurement device 20 may also include sonic calipers, proximity sensors, or other sensors suitable for determining a distance between a wall of a borehole and the expandable reamer apparatus 10. Optionally, the measurement device 20 may be configured, mounted and used to determine the position of the movable blades and/or bearing pads of the expandable reamer apparatus 20, wherein the reamed minimum borehole diameter may be inferred from such measurements. Similarly, a measurement device may be positioned within the movable blade so as to be in contact with or proximate to the formation on the borehole wall when the movable blade is actuated to its outermost fullest extent.

Figure 25:
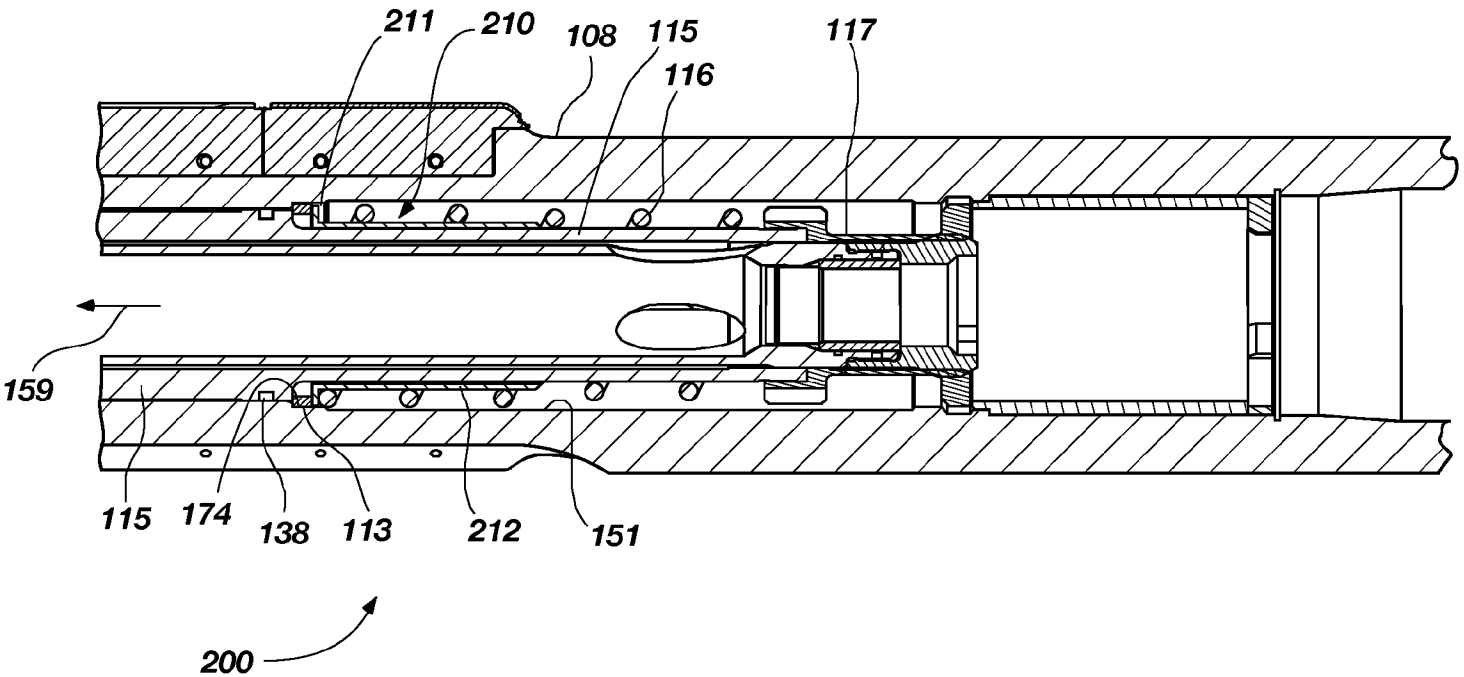
FIG. 25 shows a longitudinal cross-sectional view of an embodiment of the expandable reamer apparatus incorporating a motion limiting member.

FIG. 25 shows a cross-sectional view of a motion limiting member 210 for use with an expandable reamer apparatus 200 for limiting the extent to which blades may extend outwardly. As discussed above with respect to the upper stabilizer block 105 including a back stop for limiting the extent to which the blades may extend upwardly and outwardly along the blade tracks, the motion limiting member 210 may be used to limit the extent in which the actuating means, i.e., the push sleeve 115, may extend in the axial uphole direction 159. The motion limiting member 210 may have a cylindrical sleeve body 212 positioned between an outer surface of the push sleeve 115 and the inner bore 151 of the tubular body 108. As shown, the spring 116 is located between the motion limiting member 210 and the tubular body 108 while a base end 211 of the motion limiting member 210 is retentively retained between the spring 116 and the retaining ring 113. When the push sleeve 115 is subjected to motion, such as by hydraulic fluid pressure as described hereinabove, the spring 116 will be allowed to compress in the uphole direction 159 until its motion is arrested by the motion limiting member 210 which prevents the spring 116 and the push sleeve 115 from further movement in the uphole direction 159. In this respect, the blades of the expandable reamer apparatus 200 are prevented from extending beyond the limit set by the motion limiting member 210.

Figure 26:
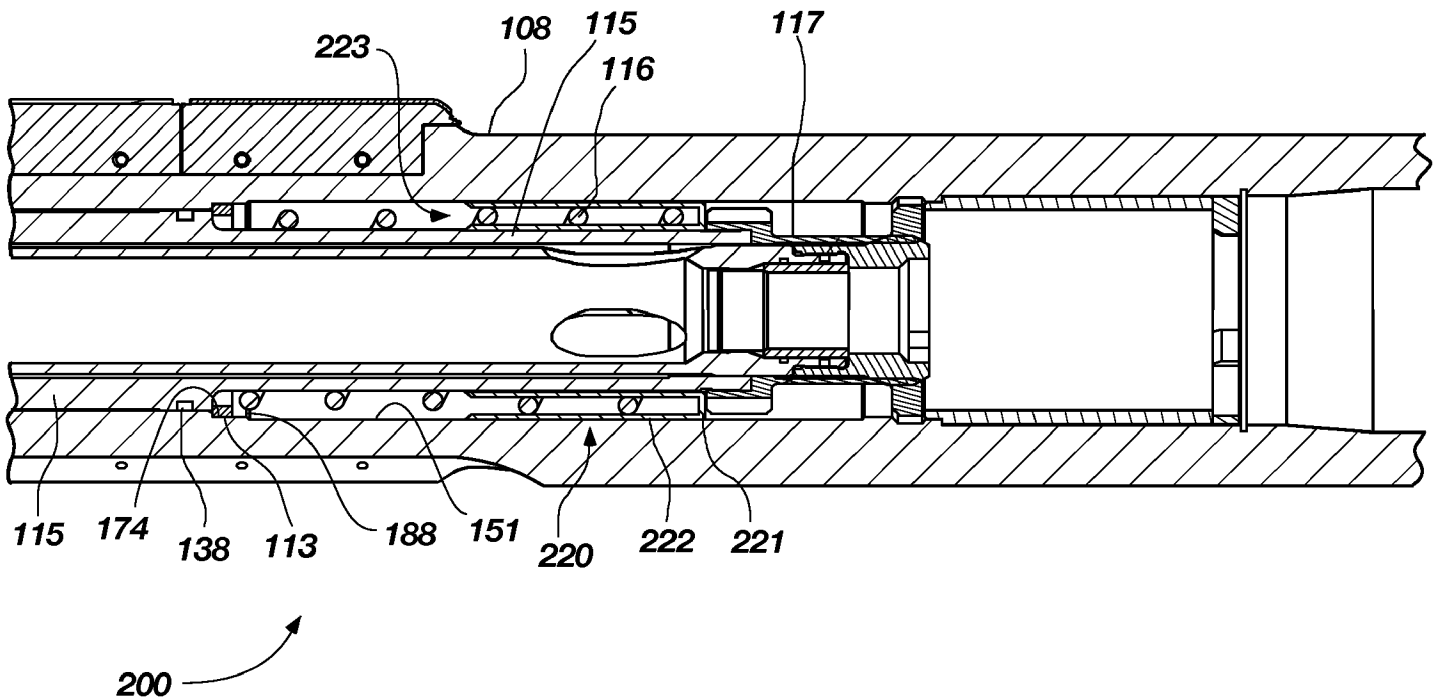
FIG. 26 shows a longitudinal cross-sectional view of an embodiment of the expandable reamer apparatus incorporating another motion limiting member.

As shown in FIG. 26, another motion limiting member 220 for use with an expandable reamer apparatus 200 is configured with a spring box body 222 having an open cylindrical section 223 and a base end 221. A portion of the spring 116 is contained within the open cylindrical section 223 of the spring box body 222 with the base end 221 resting between the spring 116 and an upper end of the lowlock sleeve 117. The motion of spring 116 and the push sleeve 115 is arrested when the spring box body 222 is extend into impinging contact with the retaining ring 113 or a ledge or lip 188 located in the inner bore 151 of the tubular body 108.

While the motion limiting members 210 and 220 (shown in FIGS. 25 and 26) are generally described as being cylindrical, they may have other shapes and configurations, for example, a pedestal, leg or elongated segment, without limitation. In a very broad sense, the motion limiting member allows the extent of axial movement to be arrested to varying degrees for an assortment of application uses, particularly when different boreholes are to be reamed with a common expandable reamer apparatus requiring only minor modifications thereto.

In other embodiments, the motion limiting members 210 or 220 may be simple structures for limiting the extent to of which the actuating means may extend to limit the motion of the blades. For example, a motion limiting member may be a cylinder that floats within the space between the outer surface of the push sleeve 115 and the inner bore 151 of the tubular body 108 either between the spring 116 and the push sleeve 115 or the spring 116 and the tubular body 108.

The expandable reamer apparatus 100, as described above with reference to FIGS. 1-23, provides for robust actuation of the blades 101, 102, 103 along the same non-binding path (in either direction) which is a substantial improvement over conventional reamers having a piston integral to the blades thereof to accumulate hydraulic pressure to operate it outward and thus requiring a differently located forcing mechanism such as springs to retract the blades back inward. In this respect, the expandable reamer apparatus includes activation means, i.e., the linkage assembly, the yoke, the push sleeve, to be the same components for extending and retracting the blades, allowing the actuating force for moving the blades to lie along the same path, but in opposite directions. With conventional reamers, the actuation force to extend the blades is not guaranteed to lie exactly in opposite directions and at least not along the same path, increasing the probability of binding. The expandable reamer apparatus herein described overcomes deficiencies associated with conventional reamers.

The expandable reamer apparatus 100 drives the actuating means, i.e., the push sleeve, axially in a first direction while forcing the blades to move to the extended position (the blades being directly coupled to the push sleeve by a yoke and linkage assembly). In the opposite direction, the push sleeve directly retracts the blades by pulling, via the yoke and linkage assembly. Thus, activation means provides for the direct extension and retraction of the blades, irrespective of the biasing spring or the hydraulic fluid as conventionally provided.

While particular embodiments have been shown and described herein, numerous variations and other embodiments will occur to those skilled in the art. Accordingly, it is intended that the embodiments only be limited in terms of the appended claims and their legal equivalents.

What is claimed is:

1. A stabilizer sub for connection to an expandable reamer apparatus used for enlarging a borehole in a subterranean formation, the stabilizer sub comprising:

a tubular body having a longitudinal axis, an upper end, a lower end, an inner bore, and an outer surface, one of the upper end and the lower end of the tubular body for direct connection to an expandable reamer apparatus without the use of drill pipe or subs located therebetween;

a drilling fluid flow path extending through the inner bore; and at least one stabilizer rib located on a portion of the outer surface of the tubular body, the at least one stabilizer rib extending in an at least partial spiral configuration around 45° or more of a circumference of the portion of the outer surface of the tubular body, the at least one stabilizer rib having a diameter thereon substantially under gage of a nominal diameter of a borehole by an amount from 0.00 inche less than the nominal borehole diameter to substantially 0.50 inche less than the nominal borehole diameter, the at least one stabilizer rib located on the stabilizer sub to be within a range of about four (4) feet to ten (10) feet of a blade of an expandable reamer apparatus connected directly thereto, the at least one stabilizer rib further comprising:

a profile including a first transition surface substantially aligned with a rotational leading edge of the at least one stabilizer rib, the first transition surface for transition from a rotational leading face of the at least one stabilizer rib to a bearing surface of the at least one stabilizer rib;

a second transition surface for transition from the rotational leading face of the at least one stabilizer rib to the first transition surface; and a layer of hardfacing alloy disposed on each of the bearing surface, the first transition surface, and the second transition surface.

2. The stabilizer sub of claim 1, wherein the at least one stabilizer rib includes a diameter thereon substantially under gage of a nominal diameter of a borehole by an amount from 0.125 inch less than the nominal borehole diameter to substantially 0.25 inch less than the nominal borehole diameter.

3. The stabilizer sub of claim 1, wherein the at least one stabilizer rib includes a diameter thereon substantially under gage of a nominal diameter of a borehole by an amount from substantially 0% less than the nominal borehole diameter to substantially 4% less than the nominal borehole diameter.

4. The stabilizer sub of claim 1, wherein the at least one stabilizer rib includes one of a diameter thereon substantially under gage of a nominal diameter of a borehole by an amount from 0.00 inch less than the nominal borehole diameter to substantially 0.50 inch less than the nominal borehole diameter or substantially smaller in diameter than the nominal borehole diameter of substantially 0% less than the nominal borehole diameter to substantially 4% less than the nominal borehole diameter.

5. The stabilizer sub of claim 1, wherein the at least one stabilizer rib comprises a plurality of surfaces.

6. The stabilizer sub of claim 5, further comprising hardfacing located on the plurality of surfaces of the at least one stabilizer rib.

7. The stabilizer sub of claim 1, wherein the at least one stabilizer rib extends one of a distance of approximately 45° of a circumference of the tubular body, of approximately 90° of the circumference of the tubular body, of approximately 180° of the circumference of the tubular body, of approximately 270° of the circumference of the tubular body, and of approximately 360° of the the circumference of the tubular body.

8. The stabilizer sub of claim 1, wherein the first transition surface comprises an arcuate surface and the second transition surface comprises a surface formed at an approximate constant radius.

9. The stabilizer sub of claim 8, wherein the profile comprises a further transition surface.

10. An expandable reamer apparatus and a stabilizer sub connected thereto for enlarging a borehole in a subterranean formation, comprising:

the expandable reamer apparatus including a tubular body having a longitudinal axis, an upper end having a threaded connection, a lower end having a threaded connection, an inner bore, an outer surface, and at least one track sloped upwardly and outwardly to the longitudinal axis;

a drilling fluid flow path extending through the inner bore;

at least one blade having at least one cutting element configured to remove material from the subterranean formation during reaming, at least one blade slidably coupled to the at least one track of the tubular body; and the stabilizer sub of claim 1 directly attached to one of the threaded connection of the upper end and the threaded connection of the lower end of the tubular body of the expandable reamer apparatus.

11. The expandable reamer apparatus and a stabilizer sub connected thereto of claim 10, wherein the at least one stabilizer rib comprises a rib including a plurality of surfaces.

12. An expandable reamer apparatus and a stabilizer sub connected thereto for enlarging a borehole in a subterranean formation, comprising:

the expandable reamer apparatus including a tubular body having a longitudinal axis, an upper end having a threaded connection, a lower end having a threaded connection, an inner bore, an outer surface, and at least one track of the tubular body sloped upwardly and outwardly to the longitudinal axis;

a drilling fluid flow path extending through the inner bore;

at least one blade having at least one cutting element configured to remove material from the subterranean formation during reaming, the at least one blade slidably coupled to the at least one track of the tubular body; and the stabilizer sub of claim 1 having a plurality of stabilizer ribs thereon, an end of the stabilizer sub directly attached to one of the threaded connection of the upper end and the threaded connection of the lower end of the tubular body of the expandable reamer apparatus.

13. The stabilizer sub of claim 1, wherein each of the first transition surface and the second transition surface are arcuate, the first transition surface comprising a first radius of curvature, the second transition surface comprising a second radius of curvature, the second radius of curvature being smaller than the first radius of curvature.

14. A method of forming a stabilizing element for an expandable reamer having at least one blade thereon, the method comprising:

forming at least three stabilizer ribs, comprising:

forming each of the at least three stabilizer ribs to extend in an at least partial spiral configuration around at least 45° of a circumference of one of a tubular housing of the expandable reamer and a tubular housing of a stabilizer sub;

configuring the at least three stabilizer ribs to have a diameter thereon substantially under gage of a nominal diameter of a borehole by an amount from 0.00 inch less than the nominal borehole diameter to substantially 0.50 inch less than the nominal borehole diameter;

forming a profile on each of the at least three stabilizer ribs, wherein forming the profile includes:

forming a first transition surface substantially aligned with a rotational leading edge of the at least one stabilizer rib, the first transition surface for transition from a rotational leading face of the at least one stabilizer rib to a bearing surface of the at least one stabilizer rib; and forming a second transition surface for transition from the rotational leading face of the at least one stabilizer rib to the first transition surface; and locating each of the at least three stabilizer ribs within at least ten (10) feet of the at least one blade on the expandable reamer.

15. The method of claim 14, wherein locating each of the at least three stabilizer ribs within at least ten (10) feet of the at least one blade on the expandable reamer comprises locating each of the at least three stabilizer ribs within a range of four (4) feet to ten (10) feet of the at least one blade of the expandable reamer.

16. The method of claim 14, further comprising:

forming at least one other stabilizer rib on one of a tubular housing of the expandable reamer and a tubular housing of a stabilizer sub; and locating each of the at least three stabilizer ribs within a range of approximately four (4) feet to approximately ten (10) feet of the at least one blade on the expandable reamer.

* * * * *

UNITED STATES PATENT AND TRADEMARK OFFICE

CERTIFICATE OF CORRECTION

PATENT NO. : 8,297,381 B2
APPLICATION NO. : 12/501688
DATED : October 30, 2012
INVENTOR(S) : Steven R. Radford, Mark R. Kizziar and Mark A. Jenkins It is certified that error appears in the above-identified patent and that said Letters Patent is hereby corrected as shown below:

In the specification:

| | | |
|---|---|---|
| COLUMN 6, | LINE 66, | change “inche” to --inch-- |
| COLUMN 6, | LINE 67, | change “inche” to --inch-- |
| COLUMN 7, | LINE 5, | change “inche” to --inch-- |

In the claims:

| | | | |
|---|---|---|---|
| CLAIM 1, | COLUMN 24, | LINE 66, | change “inche” to --inch-- |
| CLAIM 1, | COLUMN 24, | LINE 67, | change “inche” to --inch-- |
| CLAIM 7, | COLUMN 25, | LINE 48, | change “of the the” to --of the-- |

Signed and Sealed this
Fourteenth Day of July, 2015

Michelle K. Lee

Michelle K. Lee
*Director of the United States Patent and Trademark Office*